US009683806B1

(12) United States Patent
Yehle

(10) Patent No.: US 9,683,806 B1
(45) Date of Patent: Jun. 20, 2017

(54) COMPOUND ARCHERY BOW WITH ADJUSTABLE TRANSVERSE POSITION OF PULLEY ASSEMBLY

(71) Applicant: BowTech, Inc., Eugene, OR (US)

(72) Inventor: Craig T. Yehle, Holmen, WI (US)

(73) Assignee: BowTech, Inc., Eugene, OR (US)

( * ) Notice: Subject to any disclaimer, the term of this patent is extended or adjusted under 35 U.S.C. 154(b) by 0 days.

(21) Appl. No.: 15/190,125

(22) Filed: Jun. 22, 2016

(51) Int. Cl.
*F41B 5/10* (2006.01)

(52) U.S. Cl.
CPC ..... *F41B 5/105* (2013.01); *F41B 5/10* (2013.01); *Y10S 124/90* (2013.01)

(58) Field of Classification Search
CPC ..... F41B 5/10; F41B 5/105; Y10S 124/90
USPC ..... 124/23.1, 25.6, 86, 900
See application file for complete search history.

(56) References Cited

U.S. PATENT DOCUMENTS 3,990,425 A 11/1976 Ketchum
4,337,749 A * 7/1982 Barna ..... F41B 5/105 124/25.6
4,669,445 A * 6/1987 Schaar ..... F41B 5/10 124/25.6
4,686,955 A 8/1987 Larson
5,307,787 A * 5/1994 LaBorde ..... F41B 5/105 124/25.6
5,368,006 A 11/1994 McPherson
5,623,915 A 4/1997 Kudlacek
5,649,522 A * 7/1997 Troncoso ..... F41B 5/105 124/25.6
6,659,096 B1 * 12/2003 Nealy, Sr. ..... F41B 5/10 124/25.6
6,871,643 B2 3/2005 Cooper et al.
6,990,970 B1 1/2006 Darlington
7,305,979 B1 12/2007 Yehle
7,441,555 B1 10/2008 Larson
7,770,568 B1 8/2010 Yehle
8,037,876 B1 10/2011 Yehle
8,082,910 B1 12/2011 Yehle
8,181,638 B1 5/2012 Yehle
8,469,013 B1 6/2013 Obteshka et al.
(Continued)

OTHER PUBLICATIONS

U.S. Appl. No. 14/591,007 entitled "Adjustable pulley assembly for a compound archery bow" filed Jan. 7, 2015 in the names of Hyde et al.

(Continued)

*Primary Examiner* — Alexander Niconovich
(74) *Attorney, Agent, or Firm* — David S. Alavi

(57) ABSTRACT

A compound archery bow includes a pulley member that is rotatable on a transverse axle and that takes up a power cable as the bow is drawn. The pulley member is arranged so as to be fixed at any one of multiple transverse positions along its rotation axis relative to the bow limb by one or both of: (i) the transverse axle being retained on the bow limb at any one of multiple axle positions along the rotation axis by engagement of the transverse axle with the bow limb, or (ii) the pulley member being retained on the transverse axle at any one of multiple pulley positions along the transverse axle by engagement of the pulley member with the transverse axle. Performance characteristics of the bow can be optimized with respect to the transverse position of the pulley member along its rotation axis.

20 Claims, 10 Drawing Sheets

(56) References Cited

U.S. PATENT DOCUMENTS

| | | | | |
|---|---|---|---|---|
| 8,528,534 | B2 * | 9/2013 | McPherson | F41B 5/14 124/25.6 |
| 8,739,769 | B1 | 6/2014 | Obteshka et al. | |
| 9,086,249 | B2 * | 7/2015 | Peacemaker | F41B 5/10 |
| 9,091,503 | B2 * | 7/2015 | Howard | F41B 5/10 |
| 9,255,759 | B1 * | 2/2016 | Archer | F41B 5/1403 |
| 9,347,730 | B2 | 5/2016 | Obteshka | |
| 9,568,271 | B2 * | 2/2017 | Archer | F41B 5/1403 |
| 2016/0033228 | A1 * | 2/2016 | McPherson | F41B 5/105 124/25.6 |

OTHER PUBLICATIONS

U.S. Appl. No. 14/797,072 entitled "Adjustable pulley assembly for a compound archery bow" filed Jul. 11, 2015 in the name of Obteshka.

U.S. Appl. No. 15/091,572 entitled "Adjustable pulley assembly for a compound archery bow" filed Apr. 6, 2016 in the names of Obteshka et al.

U.S. Appl. No. 15/100,120 entitled "Adjustable split-cable assembly for a compound archery bow" filed Jun. 22, 2016 in the name of Yehle.

* cited by examiner

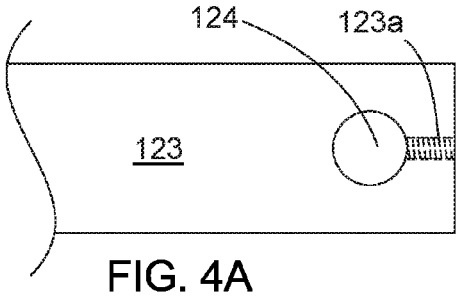
FIG. 4A
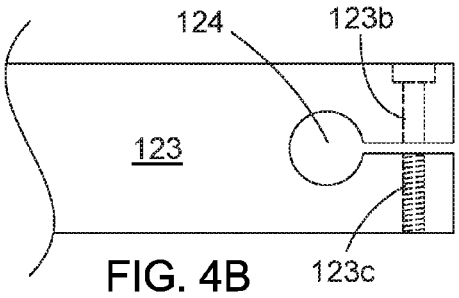
FIG. 4B
FIG. 4C
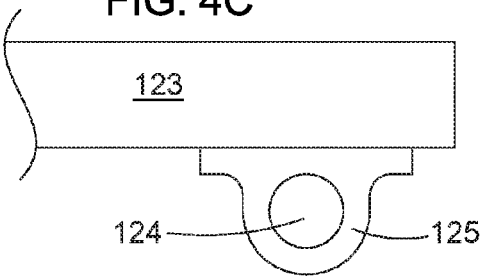
FIG. 4D
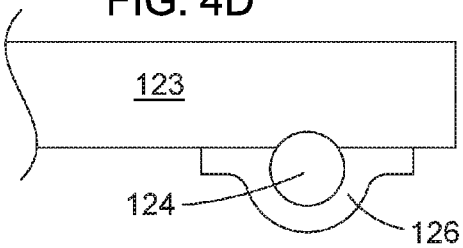
FIG. 4E
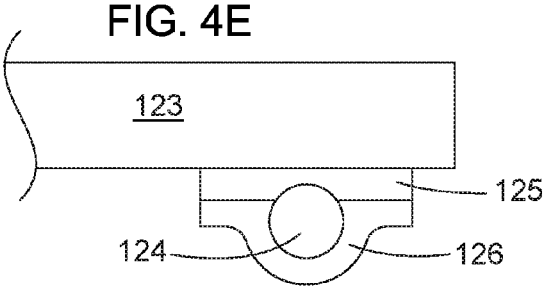
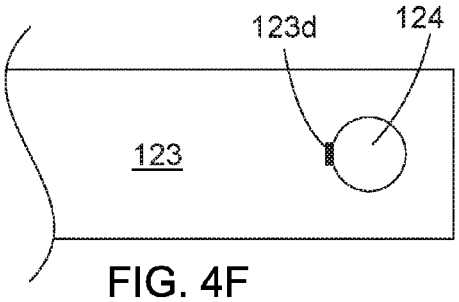
FIG. 4F
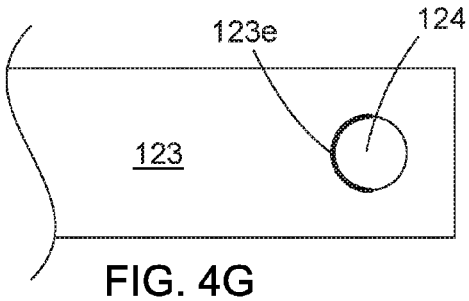
FIG. 4G
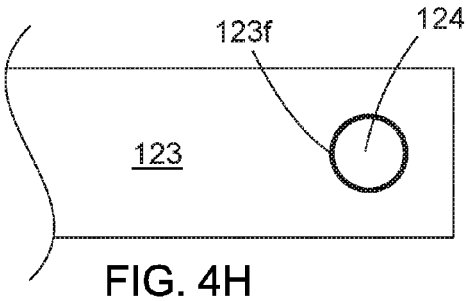
FIG. 4H

COMPOUND ARCHERY BOW WITH ADJUSTABLE TRANSVERSE POSITION OF PULLEY ASSEMBLY

FIELD OF THE INVENTION

The field of the present invention relates to compound archery bows. In particular, apparatus and methods are described herein for enabling adjustment of position or alignment of a power cable of a compound archery bow.

BACKGROUND

For purposes of the present disclosure and appended claims, the terms "compound archery bow" or "compound bow" shall denote an archery bow that uses a levering system, usually comprising one or more cables and pulleys, to bend the limbs as the bow is drawn. A wide variety of compound archery bows are disclosed in the prior art. Categories of compound archery bows include dual-cam bows (including those that employ a Binary Cam System®), single-cam bows, or hybrid-cam bows. Some examples are disclosed in the following patents, publications, and applications, each of which is incorporated by reference as if fully set forth herein:

- U.S. Pat. No. 3,990,425 entitled "Compound bow" issued Nov. 9, 1976 to Ketchum;
- U.S. Pat. No. 4,686,955 entitled "Compound archery bows" issued Aug. 18, 1987 to Larson;
- U.S. Pat. No. 5,368,006 entitled "Dual-feed single-cam compound bow" issued Nov. 29, 1994 to McPherson;
- U.S. Pat. No. 6,871,643 entitled "Eccentric elements for a compound archery bow" issued Mar. 29, 2005 to Cooper et al;
- U.S. Pat. No. 6,990,970 entitled "Compound archery bow" issued Jan. 31, 2006 to Darlington;
- U.S. Pat. No. 7,350,979 entitled "Dual-cam archery bow with simultaneous power cable take-up and let-out" issued Dec. 11, 2007 to Yehle;
- U.S. Pat. No. 7,441,555 entitled "Synchronized compound archery bow" issued Oct. 28, 2008 to Larson;
- U.S. Pat. No. 7,770,568 entitled "Dual-cam archery bow with simultaneous power cable take-up and let-out" issued Aug. 10, 2010 to Yehle;
- U.S. Pat. No. 8,037,876 entitled "Pulley-and-cable power cable tensioning mechanism for a compound archery bow" issued Oct. 18, 2011 to Yehle;
- U.S. Pat. No. 8,082,910 entitled "Pulley assembly for a compound archery bow" issued Dec. 27, 2011 to Yehle;
- U.S. Pat. No. 8,181,638 entitled "Eccentric power cable let-out mechanism for a compound archery bow" issued May 22, 2012 to Yehle;
- U.S. Pat. No. 8,469,013 entitled "Cable take-up or let-out mechanism for a compound archery bow" issued Jun. 25, 2013 to Obteshka et al;
- U.S. Pat. No. 8,739,769 entitled "Cable take-up or let-out mechanism for a compound archery bow" issued Jun. 3, 2014 to Obteshka et al;
- U.S. Pat. No. 9,347,730 entitled "Adjustable pulley assembly for a compound archery bow" issued May 24, 2016 to Obteshka;
- U.S. non-provisional application Ser. No. 14/591,007 entitled "Adjustable pulley assembly for a compound archery bow" filed Jan. 7, 2015 in the names of Hyde et al;

- U.S. non-provisional application Ser. No. 14/797,072 entitled "Adjustable pulley assembly for a compound archery bow" filed Jul. 11, 2015 in the name of Obteshka; and
- U.S. non-provisional application Ser. No. 15/091,572 entitled "Adjustable pulley assembly for a compound archery bow" filed Apr. 6, 2016 in the names of Obteshka et al.

Typically a compound archery bow includes one or two so-called power cables, one in a single- or hybrid-cam bow or two in a dual-cam bow. The examples shown in the drawings are dual-cam bows employing a Binary Cam System®. Each power cable is engaged at one end to be taken up by a power cable take-up mechanism on a corresponding pulley member mounted on one of the bow limbs. The other end is coupled to the bow (usually to the other limb or to an axle or pulley member on the other limb). As the bow is drawn and the pulley members rotate, take-up of the power cable causes deformation of the bow limbs, usually by pulling them toward one another, so as to store energy in the bow. That stored energy is released when the bow is shot and the bow limbs return to their initial shapes. Consequently, the power cable is under considerable tension when the bow is drawn, and that tension produces forces and torques on the pulley members and limbs of the bow. Because the power cable is flexible, the lines of force necessarily are parallel to each free segment of the power cable.

If left in a straight path from one pulley member to the other, the power cable would interfere with movement of the arrow in the shooting plane of the bow (i.e., a plane defined by movement of the draw cable as the bow is drawn and then shot). A so-called cable guard can be employed to deflect the power cable laterally out of the shooting plane; if there are two power cables, both can be deflected in the same direction by a single cable guard, or the two power cables can be deflected in opposite directions, each by its own corresponding cable guard. However, lateral deflection of a power cable out of the shooting plane also causes the lines of force applied by that power cable to be misaligned with respect to the shooting plane. Such an arrangement can produce undesirable lateral deflection or twisting of the pulley members or the limbs, in turn leading potentially to shooting inaccuracy, poor arrow flight, accelerated wear or damage, or other problems.

It would be desirable to provide a compound archery bow having adjustable position or alignment of a power cable, to enable at least partial compensation for the misalignments described above or for other sources of inaccuracy or misalignment in a compound archery bow or during its use.

SUMMARY

An inventive compound archery bow comprises a substantially rigid riser, first and second resilient bow limbs, first and second transverse axles, first and second pulley members, a draw cable, and a power cable. The first bow limb extends from a first end portion of the riser; the second bow limb extends from a second end portion of the riser. The first transverse axle is mounted on the first bow limb so as to define a first transverse axis; the first pulley member is connected to the first transverse axle between spaced-apart end portions of the first bow limb, is rotatable relative to the first bow limb around the first rotation axis, and includes a first draw cable groove and a power cable take-up mechanism. The second transverse axle is mounted on the second bow limb so as to define a second transverse axis; the second pulley member is connected to the second transverse axle between spaced-apart end portions of the second bow limb, is rotatable relative to the second bow limb around the second rotation axis, and includes a second draw cable groove. The draw cable is engaged with the first and second draw cable grooves and arranged to rotate the first and second pulley members as the bow is drawn and the draw cable is let out from the first and second draw cable grooves. The power cable is engaged to be taken up by the power cable take-up mechanism of the first pulley member as the bow is drawn and the first pulley member rotates, and is coupled to the bow so as to cause deformation of one or both bow limbs as the power cable is taken up. The first pulley member is fixed at any one of multiple transverse positions along the first rotation axis relative to the first bow limb by one or both of: (i) the first transverse axle being retained on the first bow limb at any one of multiple axle positions along the first rotation axis by engagement of the first transverse axle with the first bow limb, or (ii) the first pulley member being retained on the first transverse axle at any one of multiple pulley positions along the first transverse axle by engagement of the first pulley member with the first transverse axle.

A method for rigging the inventive compound archery bow comprises: (A) fixing the first pulley member at a selected one of the multiple transverse positions along the first rotations axis; (B) engaging the draw cable with the first and second draw cable grooves so that the first and second pulley members rotate and let out the draw cable as the bow is drawn; and (C) coupling the power cable to the bow and engaging the power cable with the power cable take-up mechanism so that the power cable is taken up as the first pulley member rotates as the bow is drawn, thereby causing deformation of one or both bow limbs. The bow can be adjusted by moving the first pulley member from a first one of the multiple transverse positions along the first rotations axis to a different, second one of the multiple transverse positions along the first rotations axis.

Objects and advantages pertaining to compound archery bows may become apparent upon referring to the example embodiments illustrated in the drawings and disclosed in the following written description or appended claims.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

FIGS. 4A through 4H illustrate schematically different example arrangements of a bore through the end portion of a bow limb.

The embodiments depicted are shown only schematically: all features may not be shown in full detail or in proper proportion, certain features or structures may be exaggerated relative to others for clarity, and the drawings should not be regarded as being to scale. The embodiments shown are only examples: they should not be construed as limiting the scope of the present disclosure or appended claims.

DETAILED DESCRIPTION OF EMBODIMENTS

Figure 1:
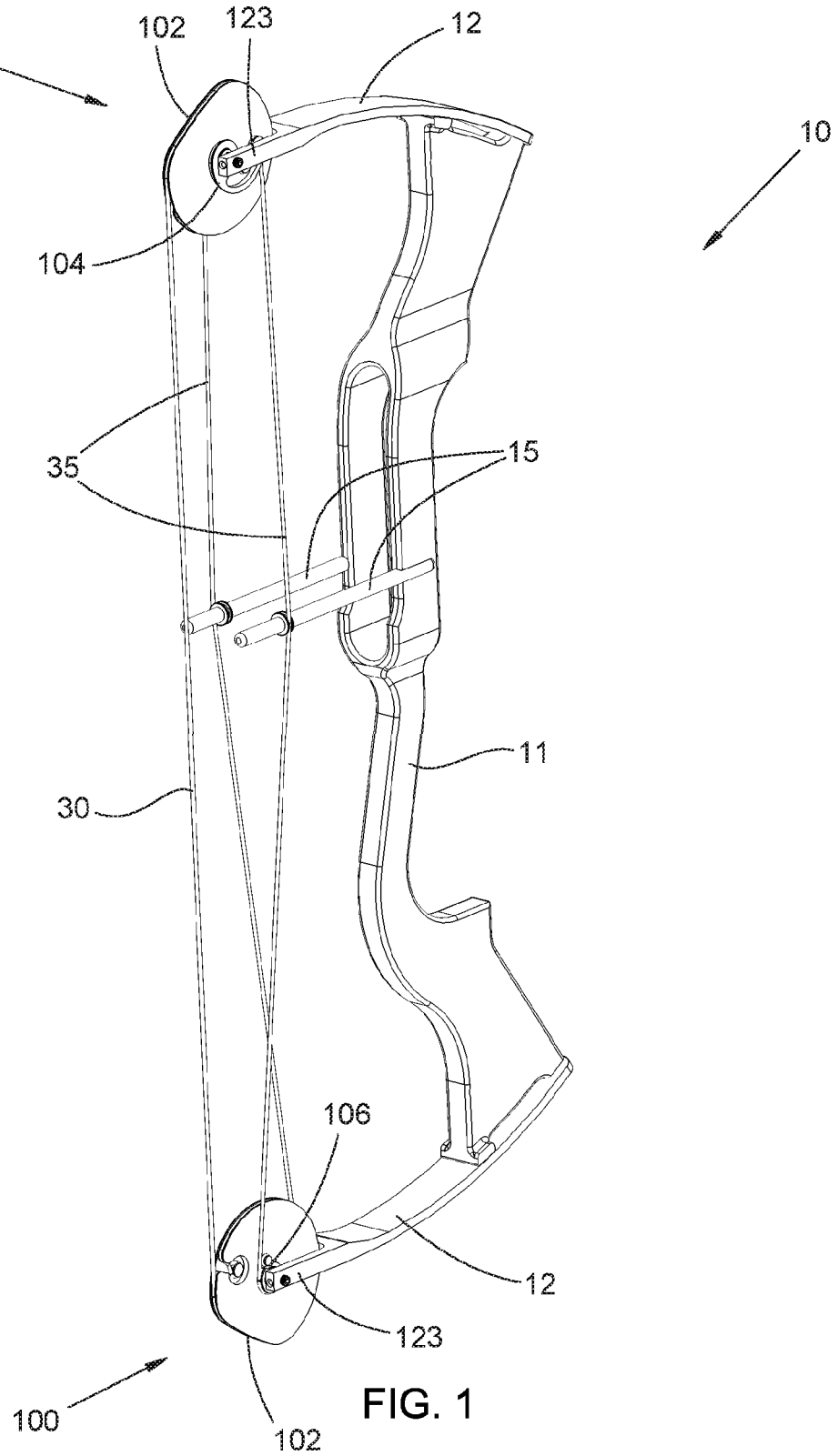
FIG. 1 illustrates a first example of a compound archery bow.
Figure 2:
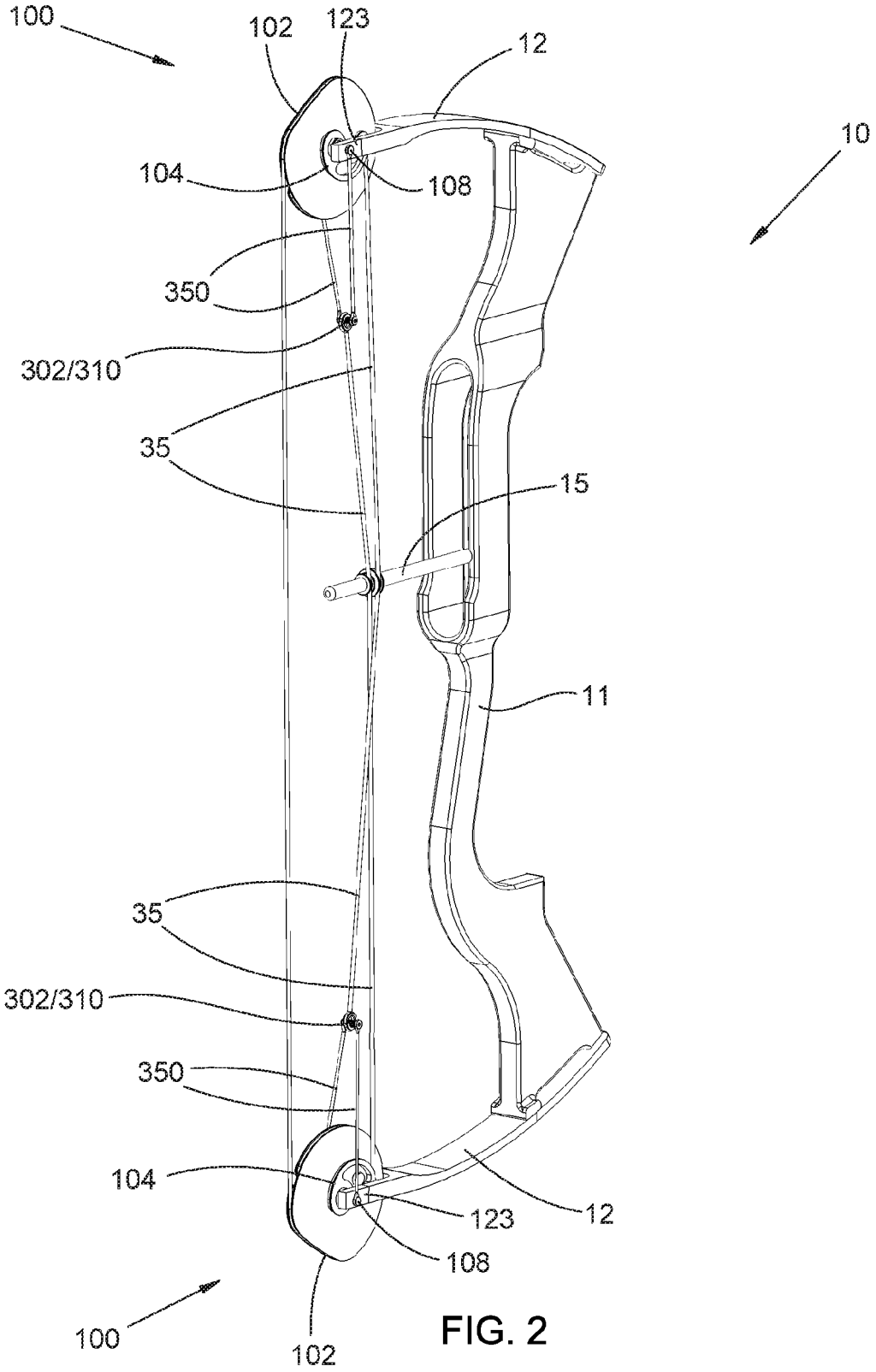
FIG. 2 illustrates a second example of a compound archery bow.

Typically a compound archery bow 10 includes a substantially rigid central riser 11, a pair of resilient bow limbs 12 extending from corresponding end portions of the riser 11, corresponding pulley members 100 rotatably mounted on the bow limbs 12, a draw cable 30, and one (in a single- or hybrid-cam bow) or two (in a dual-cam bow) power cables 35. The examples of inventive arrangements that are shown in the drawings are implemented on dual-cam bows employing a Binary Cam System®, with two power cables 35 and pulley assemblies 100 that typically are identical (as in FIG. 1) or mirror images of each other (as in FIG. 2). The inventive arrangements disclosed herein also can be employed with single- and hybrid-cam compound bows, in which only a single power cable 35 is employed, the pulley assemblies 100 differ from each other, and one or more additional cables are employed. The following descriptions of inventive arrangements of a pulley assembly 100 or a power cable 35 shall apply to any of a single pulley assembly 100 or a single power cable 35 of a single- or hybrid-cam bow, or to both pulley assemblies 100 or both power cables 35 of a dual-cam compound bow.

The draw cable 30 is engaged with draw cable grooves 102 of the pulley members 100 and are let out from the draw cable grooves 102 as the bow 10 is drawn and the pulley members 100 rotate. The power cable 35 is engaged at a first end to be taken up by a power cable take-up mechanism on the pulley member 100 as the bow 10 is drawn and the pulley member 100 rotates. Typically the power cable take-up mechanism comprises a non-circular or eccentrically mounted pulley with a peripheral power cable groove 104; other arrangements can be employed (e.g., a set of one or more eccentrically mounted anchors or posts, or an additional power cable groove). The second end of the power cable 35 is coupled to the bow, usually to the other limb 12, to the other pulley member 100 (e.g., let out from the groove 106 as in FIG. 1, or taken up then let out by the eccentrically mounted anchor 108 as in FIG. 2), or to an axle on which the other pulley member 100 is mounted; or in some cases the second end of the power cable 35 is coupled to the riser 11 or to a stock of a crossbow. In some examples (e.g., as in U.S. Pat. Nos. 7,350,979 and 7,770,568 incorporated above, and in the examples shown, all of which employ a Binary Cam System®) the second end of the power cable 35 is let-out by the other pulley member 100 over at least a latter portion of drawing the bow (as in FIGS. 1 and 2); in some examples (e.g., U.S. Pat. No. 8,181,638 incorporated above) the second end of the power cable also can be taken up during an initial portion of drawing the bow (as in FIG. 2). As the bow 10 is drawn and the pulley members 100 rotate, the draw cable 30 is let out from draw cable grooves 102 of both pulley members 100. Take-up of the power cable 35 by the power-cable take-up mechanism of the pulley member 100 (into the power-cable groove 104 in the examples shown) causes deformation of the bow limbs 12, usually by pulling them toward one another, which in turn results in storage of energy by the bow 10. That stored energy is released when the bow 10 is shot and the bow limbs 12 return to their initial shapes (i.e., their shapes at brace). Consequently, the power cable 35 is under considerable tension when the bow 10 is drawn, and that tension produces forces and torques on the pulley members 100 and limbs 12 of the bow. Because the power cable 35 is flexible, the lines of force necessarily are aligned along each free segment of the power cable.

If left in a straight path from one pulley member 100 to the other, the power cable 35 would interfere with movement of the arrow in the shooting plane of the bow 10 (i.e., a plane defined by movement of the draw cable 30 as the bow is drawn and then shot). A so-called cable guard 15 can be employed to deflect the power cable 35 laterally out of the shooting plane; if there are two power cables 35, both can be deflected in the same direction by a single cable guard 15 (e.g., as in FIG. 2), or the two power cables 35 can be deflected in opposite directions, each by its own corresponding cable guard 15 (e.g., as in FIG. 1). However, lateral deflection of a power cable 35 out of the shooting plane also causes the lines of force applied by that power cable to be misaligned with respect to the shooting plane. Such an arrangement can produce undesirable lateral deflection or twisting of the pulley members 100 or the limbs 12 on which they are mounted, in turn leading potentially to shooting inaccuracy, poor arrow flight, accelerated wear of or damage to the bow's components, or other problems.

It would be desirable to provide a compound archery bow having adjustable position or alignment of a power cable, to enable at least partial compensation for the misalignments described above or for other sources of inaccuracy or misalignment in a compound archery bow or during its use.

In some inventive embodiments of a compound bow, the pulley member 100 can be fixed at any one of multiple transverse positions along its rotation axis relative to the bow limb 12, between spaced-apart end portions 123 of the bow limb 12. Altering the transverse position of the pulley member 100 relative to the bow limb 12 alters the position and alignment of the draw cable 30 and the power cable 35 engaged with the pulley member 100. The transverse position of the pulley member 100 can be optimized with respect to any desired parameter that characterizes behavior of the bow. In one example, a user can fire arrows at a target with the pulley member 100 at different transverse positions, and choose the position that appears to yield the most accurate arrow flight, the smallest grouping of arrows on a target, or a single, small hole through a paper sheet at close range; other suitable optimizations can be employed. The multiple transverse positions can be a set of discrete transverse positions, or a continuously variable range of transverse positions. The spaced-apart portions of the bow limb can comprise a pair of forked end portions 123 of a single bow limb 12 (as in the examples shown in the drawings), or the split-limb portions of a split-limb bow limb (i.e., a two-piece bow limb; not shown). Multiple transverse positions of the pulley member 100 can be employed in a compound bow 10 that is arranged as a dual-cam, single-cam, or hybrid-cam compound bow. In any of those bow types, one or both pulley assemblies 100 can be movable among multiple transverse positions. In some examples, movement of the pulley member 100 among the multiple transverse positions can be effected by the transverse axle 150 being retained on the bow limb 12 at any one of multiple axle positions along the its rotation axis by engagement of the transverse axle 150 with the bow limb 12. In some examples, movement of the pulley member 100 among the multiple transverse positions can be effected by the pulley member 100 being retained on the corresponding transverse axle 150 at any one of multiple pulley positions along the transverse axle by engagement of the pulley member 100 with the transverse axle 150. Either of those inventive arrangements (i.e., multiple axle positions on bow limb, or multiple pulley positions along axle), or both together, can be employed as needed or desired in a given compound archery bow.

In some embodiments, the transverse axle 150 is retained, in a pair of coaxial bores 124 through the spaced-apart portions 123 of the bow limb 12, at any one of the multiple axle positions along the rotation axis of the pulley member 100. Engagement of the transverse axle 150 with the bow limb 12 holds the axle at a selected transverse position. The bores 124 through the end portions 123 of the limb 12 can be formed in any suitable way. Examples are illustrated schematically in the drawings and can include a bore 124 directly through the limb end portion 123 (e.g., as in FIGS. 4A, 4B, 4F, 4G, and 4H), a bore 124 through a pillow block 125 that is in turn secured to the limb end portion 123 (e.g., as in FIG. 4C), or a two-piece bore 124 with a clamping member 126 forming a portion of the circumference of the bore 124 and secured to the limb end portion 123 (e.g., as in FIG. 4D) or to a pillow block 125 (e.g., as in FIG. 4E) that forms the rest of the circumference of the bore 124, with the shaft 150 held between them. Any of those bore arrangements can be implemented in any of the disclosed examples of compound bows. For purposes of the present disclosure and appended claims, any recitation of a bore through an end portion of a bow limb shall encompass all of those arrangements unless explicitly limited to fewer than all of them.

In some embodiments (e.g., the example shown in FIG. 3), at least one lateral portion of the transverse axle 150 is externally threaded, and the corresponding coaxial bore 124 is internally threaded. Typically both lateral portions and both bores 124 are threaded to provide more robust engagement of the axle 150 with the bow limb 12; that arrangement is described below, but those descriptions also apply to arrangements that include only a single threaded lateral portion of the axle 150 engaged with a single threaded bore 124 on the bow limb 12. Engagement of the transverse axle 150 with the bow limb 12 is effected by threaded engagement of each threaded lateral portion of the transverse axle 150 in a corresponding threaded bore 124 of the bow limb 12. Movement of the transverse axle 150 along the first rotation axis, relative to the bow limb 12, is effected by rotation of the transverse axle 150 threadedly engaged in the threaded bores 124. A substantially continuous range of transverse axle positions can be realized in this threaded arrangement. One or both ends of the transverse axle 150 has a socket, hex, slot, Phillips, or other suitable screw drive to enable adjustment of the transverse position of the axle 150 relative to the limb 12.

Once the transverse axle 150 is moved to a selected transverse axle position, a variety of arrangements can be employed, on one or both bow limb end portions 123, to reduce or eliminate unwanted further transverse movement of the axle. In the example of FIG. 4A, a set screw in threaded hole 123*a* into the bore 124 is employed to retain the axle 150 at the selected position; a similar arrangement can be employed in the example of FIG. 4C. In the example of FIG. 4B, one or both end portions 123 of the bow limb 12 are arranged to act a clamp tightened using a screw through the clearance hole 123*b* and threaded into hole 123*c*; the pillow block 125 in the example arrangement of FIG. 4C could be similarly arranged as a clamp. Each one of the examples of FIGS. 4D and 4E can be secured with a set screw (as in FIG. 4A), or can be arranged as a clamp by leaving a small clearance between the clamping member 126 and the limb end portion 123 (as in FIG. 4D) or the pillow block 125 (as in FIG. 4E) and tightening the clamping member 126 onto the axle 150 at the selected axle position.

In the example of FIG. 4F, a resilient plug, pellet, or longitudinal strip 123*d* is disposed within the bore 124 (secured to either the bore 124 or to the transverse axle 150); in the example of FIG. 4G, a resilient coating is bonded to threads (of either the bore 124 or the transverse axle 150) around only a portion of the circumference of the threads; in the example of FIG. 4H, a resilient circumferential threaded insert 123*f* is secured within the bore 124. A common material for the resilient members 123*d*/123*e*/123*f* is nylon; other suitable one or more resilient materials (i.e., elastically deformable materials) can be employed. In the examples of FIGS. 4F and 4G, compression of the resilient member 123*d*/123*e* (i.e., the plug, pellet, strip, or coating), upon threaded engagement of the axle 150 in the bore 124, urges the respective threads against each other on the opposite side of the bore/axle; in the example of FIG. 4H, the threaded insert is slightly undersized resulting in an interference fit of the threadedly engaged axle 150. In each of these example arrangements (FIGS. 4F through 4H), the resulting increased friction between the respective threads of the bore 124 and axle 150 retains the transverse axle 150 at the selected position, unless sufficiently large torque is applied by a user using the screw drive (i.e., unless the so-called prevailing torque of the engaged threads is exceeded).

Figure 5:
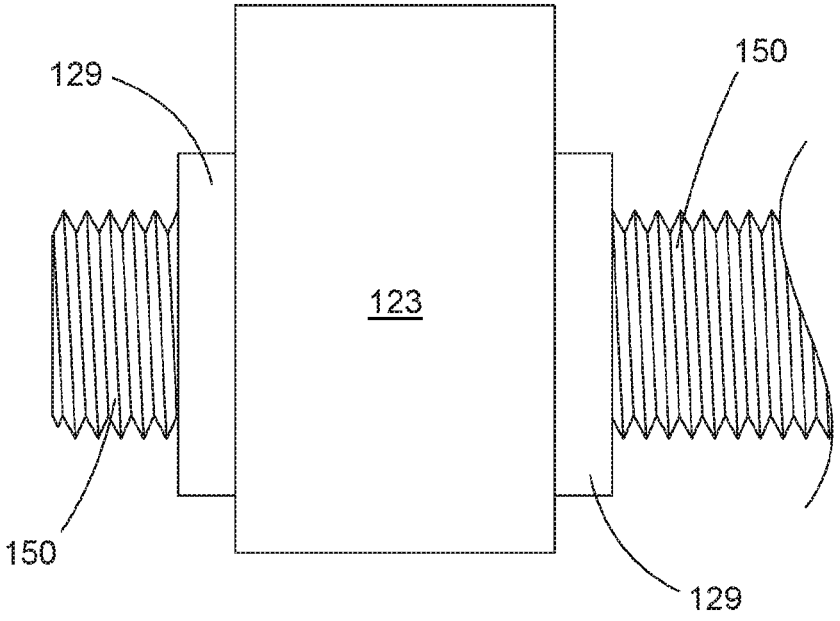
FIG. 5 illustrates schematically an example arrangement of retaining members engaging a threaded axle and a bow limb end portion.
Figure 7A:
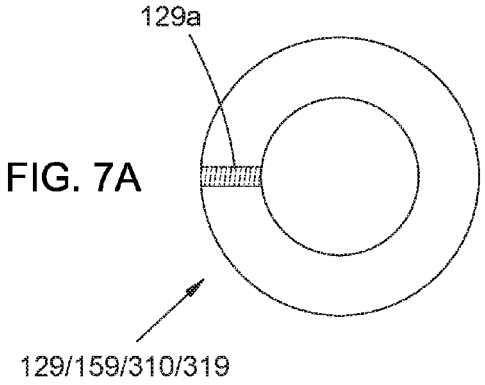
FIGS. 7A through 7F illustrate schematically examples of retaining members arranged to engage an axle or a coupling member, or power cable anchors arranged to engage a coupling member.
Figure 7B:
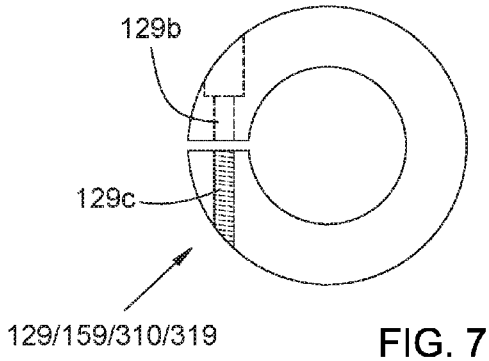
Figure 7C:
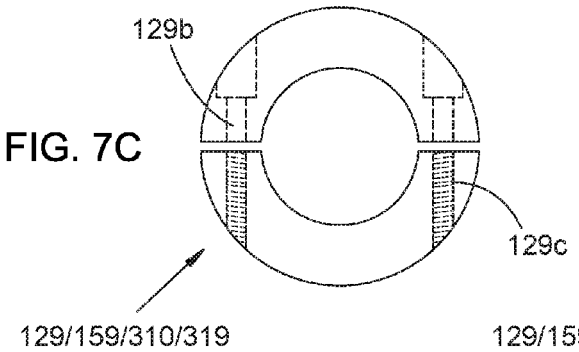
Figure 7D:
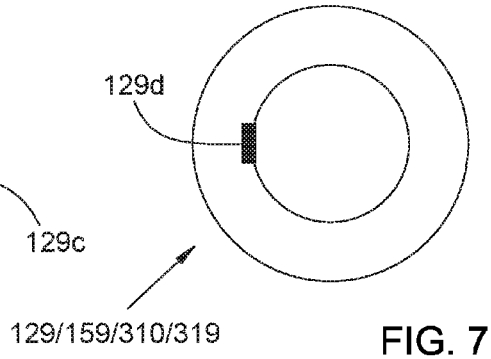
Figure 7E:
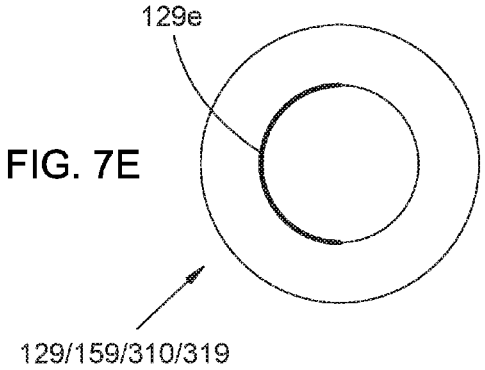
Figure 7F:
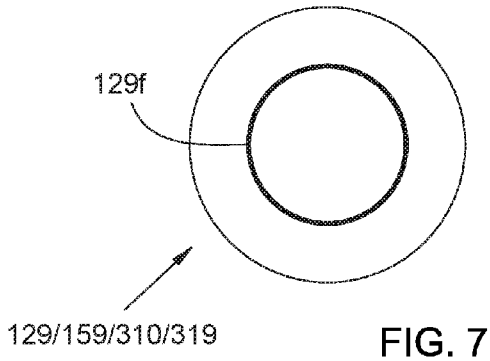

Instead of, or in addition to, threaded engagement of the axle 150 in the bores 124, one or more separate retaining members 129 can be employed to retain the threaded axle 150 at the selected transverse position relative to the bow limb 12 (e.g., as in FIG. 5). In one example, the retaining members 129 can be internally threaded and threadedly engaged on the threaded portions of the axle 150 on one or both sides of one or both of the bow limb end portions 123. A retaining member 129 tightened against the bow limb end portion 123 can act as a lock nut or jam nut and hold the axle 150 in place. One such threaded retaining member 129 on the axle 150 might be sufficient; two, three, or four threaded retaining members can provide more robust engagement of the axle 150 with the bow limb 12. In the examples of FIG. 7D through 7F, a resilient plug, pellet, or longitudinal strip 129*d*, a resilient coating 129*e*, or a resilient circumferential threaded insert 129*f*, respectively, is disposed within the threaded central passage of the retaining member 129. The resulting frictional engagement retains the retaining member 129 in place (as discussed above for the axle 150 threadedly engaged in the bore 124). With or without internal threads, one or more retaining members 129 can be held in place by set screws in corresponding threaded holes 129*a* (e.g., arranged as in FIG. 7A), or be arranged as one-piece or two-piece clamps secured with screws inserted through corresponding clearance holes 129*b* and threaded into corresponding threaded holes 129*c* (e.g., arranged as in FIG. 7B or 7C, respectively), and act as retaining flanges on the axle 150. At least two such retaining members 129 are needed to retain the axle 150 at the selected position; three or four such retaining members 129 can provide more robust engagement of the axle 150 with the bow limb 12.

In some embodiments, one or both lateral portions of the axle 150 are threaded, but the bores 124 need not be threaded. Two or more threaded retaining flanges 129 can be employed (e.g., arranged as in FIG. 5) to engage one or both end portions 123 of the bow limb 12 to retain the axle 150 at a selected transverse axle position. Rotation of the threaded retaining flanges 129 along the threaded lateral portion also effects transverse movement of the axle 150 along its axis. A substantially continuous range of transverse axle positions can be realized in this threaded arrangement. Two threaded retaining members are sufficient to retain the axle 150 at a selected transverse position; three of four such retaining members can provide more robust engagement of the axle 150 with the bow limb 12. The threaded retaining flanges can be arranged according to any of FIGS. 7A through 7F.

Figure 6:
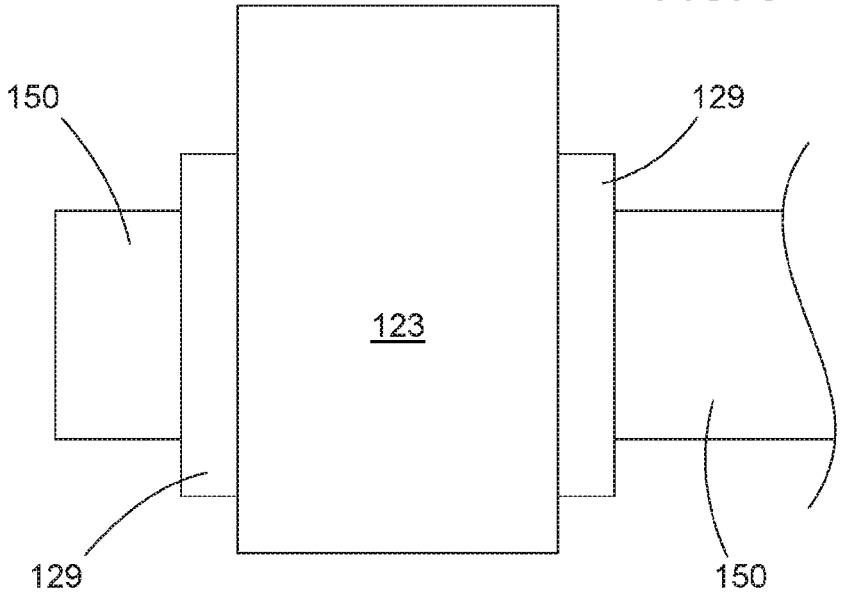
FIG. 6 illustrates schematically an example arrangement of retaining members engaging a non-threaded axle and a bow limb end portion.

In some embodiments, neither the axle 150 nor the bores 124 need to be threaded (e.g., arranged as in FIG. 6). In one such arrangement, one or both bow limb end portions 123, pillow blocks 125, or clamping members 126 can include a hole 123*a* for a set screw (e.g., as in FIG. 4A, 4C, 4D, or 4E) or can be arranged as a clamp (e.g., arranged as in FIG. 4B, 4D, or 4F) to retain the axle 150 at a selected transverse axle position. In another such arrangement, two or more retaining members 129 can be held in place by set screws in corresponding threaded holes 129*a* (e.g., as in FIG. 7A), or be arranged as one-piece or two-piece clamps (e.g., as in FIG. 7B or 7C), and act as retaining flanges on the axle 150. At least two such retaining members 129 are needed to retain the axle 150 at the selected position; three or four such retaining members 129 can provide more robust engagement of the axle 150 with the bow limb 12. In any of these non-threaded arrangements, the axle 150 can be moved to a selected transverse position (e.g., simply by pushing or pulling) and the set screw engaged, the clamp tightened, or the retaining flanges 129 moved into place and secured, to engage the axle 150 and the bow limb 12 to retain the axle 150 at the selected transverse axle position. These non-threaded arrangements can provide a substantially continuous range of transverse axle positions; alternatively, the axle 150 or the retaining flanges 129 can be arranged to enable attachment of the retaining members 129 to the axle 150 at only discrete positions along the axle, e.g., using a set of slots, grooves, or depressions arranged along the axle 150 that engage a set screw or a mating structure of the retaining flanges 129. In one such example, at least one or both lateral portions of the shaft 150 can include a set of circumferential grooves, and two or more snap rings can be employed as the retaining flanges 129.

Figure 3:
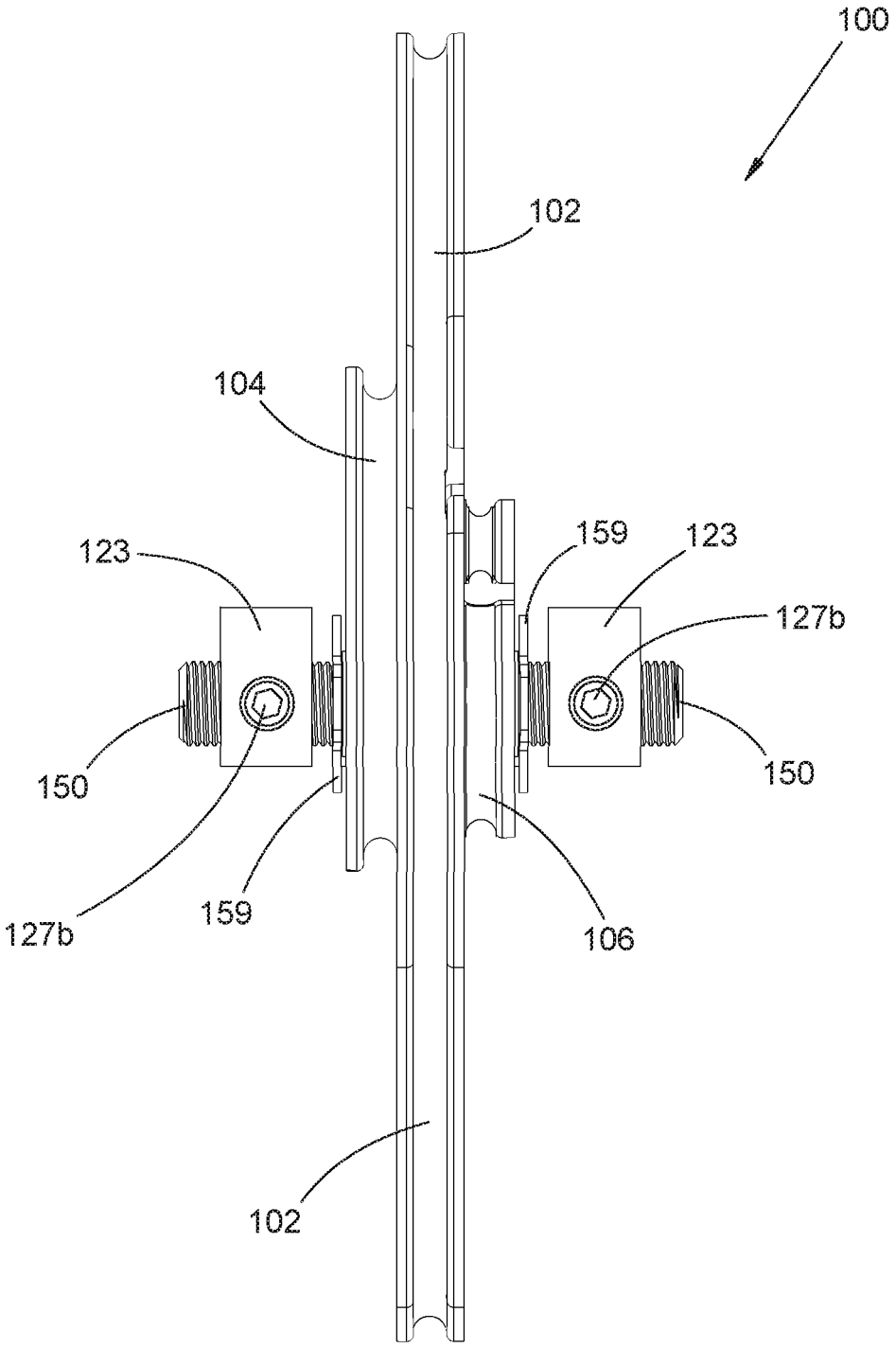
FIG. 3 illustrates an example of a pulley assembly and a threaded axle mounted between spaced-apart end portions of a bow limb.

In embodiments in which there is threaded engagement of the axle 150 with the bow limb 12 or retention of the axle 150 by tightening of a threaded retaining member 129 against the bow limb 12, rotation of the axle 150 relative to the bow limb 12 is undesirable. Such rotation would cause transverse movement of the axle 150 in the former or loosening of the retaining members 129 in the latter. In such embodiments, the pulley member 100 is rotatably mounted on the axle 150, so that the pulley member 100 can rotate independently of the axle 150 when the bow is drawn and shot. A bearing of any suitable type or arrangement can be employed for enabling rotation of the pulley member 100 about the axle 150, if needed or desired. Any suitable arrangement can be employed for substantially preventing movement of the pulley member 100 along the axle 150 while permitting rotation of the pulley member 100 about the axle 150 (including some of those described further below). In the example of FIG. 3, a pair of snap rings engaged in grooves around the axle act as retaining members 159. In embodiments lacking threaded engagement of the axle 150 with the bow limb 12 and lacking retention of the axle 150 by tightening of a threaded retaining member 129 against the bow limb 12, the axle 150 can rotate relative to the bow limb 12, the pulley member 100 can rotate relative to the axle 150, or both. If the axle 150 rotates relative to the bow limb 12, a bearing of any suitable type or arrangement can be employed, if needed or desired.

Instead of, or in addition to, the inventive arrangements described above (in which the axle 150 can be secured to the bow limb 12 at one of multiple transverse axle positions), in some embodiments, the pulley member 100 is retained on the transverse axle 150 at any one of the multiple pulley positions along the transverse axle 150. Retention of the pulley member 100 at a selected one of the multiple positions along the axle 150 is effected by engagement of the pulley member with the transverse axle. That inventive arrangement is in contrast with some conventional arrangements in which (i) washers, spacers, or shims of various number or thicknesses are interposed between the pulley member and the end portions of the bow limb to constrain the position of the pulley member on the axle, and (ii) there is no direct engagement between the pulley member and axle that acts to hold the pulley member at the selected position on the axle.

Figure 8:
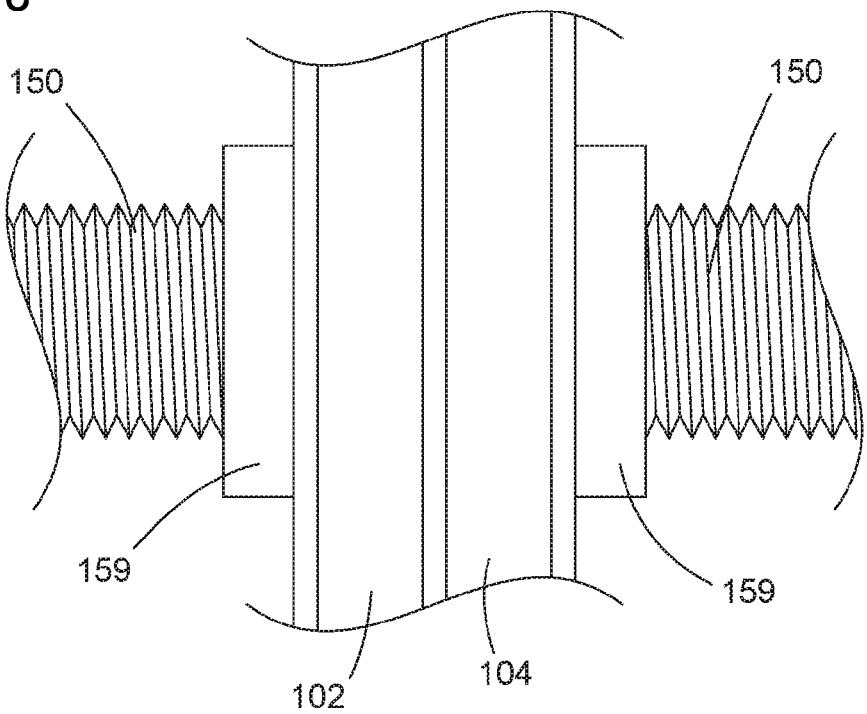
FIG. 8 illustrates schematically an example arrangement of retaining members engaging a threaded axle and a pulley member.

In some embodiments, a central portion of the axle 150 is externally threaded, and a central bore through the pulley member 100 is internally threaded. Threaded engagement of the pulley member 100 with the axle 150 retains the pulley member at a selected one of multiple pulley positions along the axle 150, and can provide a substantially continuous range of multiple pulley positions along the axle. Relative rotation of the threadedly engaged axle 150 and pulley member 100 effects movement of the pulley member 100 among the multiple pulley member positions along the axle 150. In some examples, a resilient member (e.g., a pellet, plug, strip, coating, or threaded insert) can be disposed within the central bore of the pulley member 100 and the threads of the axle 150 (as described above for the axle 105 threadedly engages within bores 124). More typically, one or more retaining members 159, such as any of those described above, can be employed to retain the pulley member 100 at a selected one of multiple pulley positions along the transverse axle 150 (e.g., arranged as in FIG. 8). In some examples, a threaded retaining member 159, threadedly engaged with the axle 150 and tightened against the pulley member 100, can act as a lock nut or jam nut and hold the pulley member 100 in place. One such threaded retaining member 159 on the axle 150 might be sufficient; two threaded retaining members can provide more robust engagement of the pulley member 100 with the axle 150. Instead of internal threads, in some other examples a pair or retaining members 159 can be held in place by set screws (e.g., as in FIG. 7A), can be arranged as one-piece or two-piece clamps (e.g., as in FIG. 7B or 7C, respectively), or can include a resilient member (e.g., as in FIGS. 7D through 7F), and act as retaining flanges on the axle 150 on opposite sides of the pulley member 100.

In some embodiments, the central portion of the axle 150 is threaded, but the central bore of the pulley member 100 need not be threaded. Two threaded retaining flanges 159 can be employed (e.g., arranged as in FIG. 8) to engage both sides of the pulley member 100 between them and retain the pulley member 100 at the selected pulley position along the axle 150. Rotation of the threaded retaining members 159 along the threaded central portion 151 also effects transverse movement of the pulley member 100 along the axle 150. A substantially continuous range of pulley positions along the axle can be realized in this threaded arrangement. The threaded retaining flanges 159 can be retained at the desired positions using any of the arrangements shown in FIGS. 7A through 7F.

Figure 9:
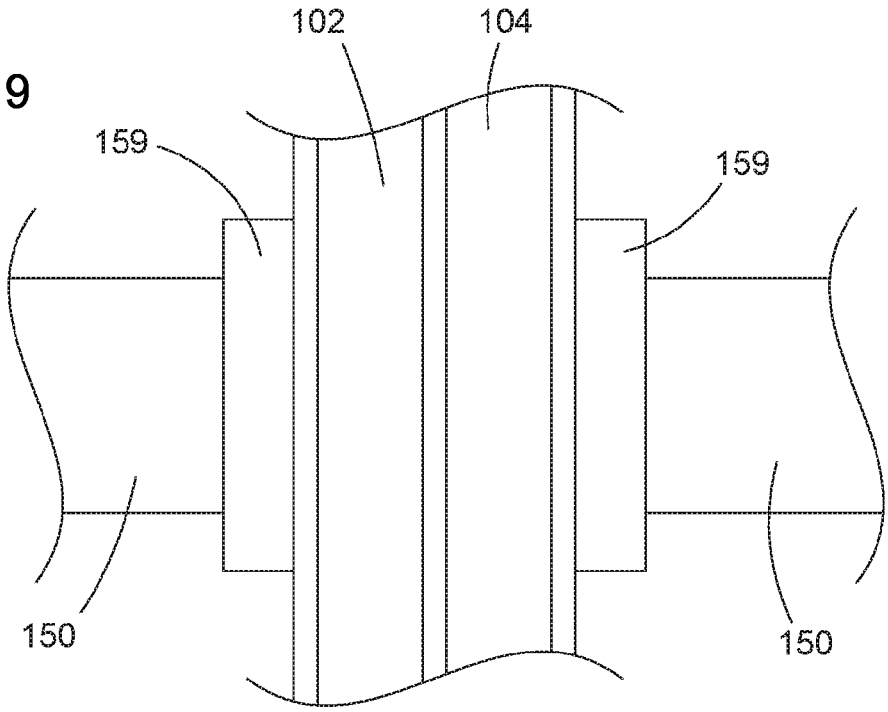
FIG. 9 illustrates schematically an example arrangement of retaining members engaging a non-threaded axle and a pulley member.

In some embodiments, neither the axle 150 nor a central bore through the pulley member 100 need to be threaded, but can be retained by a pair of retaining flanges 159 (e.g., arranged as in FIG. 9). In one such arrangement, two retaining flanges 159 on opposite sides of the pulley member 100 can be held in place by set screws (e.g., as in FIG. 7A), or be arranged as one-piece or two-piece clamps (e.g., as in FIG. 7B or 7C), and act as retaining flanges on the axle 150. In any of these non-threaded arrangements, the pulley member 100 can be moved to a selected pulley position along the axle 150 (e.g., simply by pushing or pulling), and the retaining members 159 can be moved into place against the pulley member 100 and secured, to engage the pulley member 100 with the axle 150 to retain the pulley member 100 at the selected pulley position. These non-threaded arrangements can provide a substantially continuous range of transverse axle positions; alternatively, the axle 150 or the retaining members 159 can be arranged to enable attachment of the retaining members 159 to the axle 150 at only discrete positions along the axle, e.g., using a set of slots, grooves, or depressions arranged along the axle 150 that engage a set screw or a mating structure of the retaining member 159. In one such example, the central portion of the shaft 150 can include a set of circumferential grooves, and two snap rings can be employed as the retaining members 159. Any of the above arrangements can also be used to retain the pulley member 100 on the axle 150 in a single pulley position, in some of the embodiments described earlier in which the axle is moveable among multiple axle positions.

In embodiments in which there is threaded engagement of the pulley member 100 with the axle 150 or retention of the pulley member 100 by tightening of a threaded retaining member 159 against the pulley member 100, rotation of the pulley member 100 relative to the axle 150 is undesirable. Such rotation would cause transverse movement of the pulley member 100 in the former or loosening of the threaded retaining members 159 in the latter. In such embodiments, the axle 150 is rotatably mounted on the bow limb 12, so that the pulley member 100 and the axle 150 can rotate together when the bow is drawn and shot. Any suitable arrangement can be employed for substantially preventing transverse movement of the axle 150 along its rotation axis while permitting rotation of the axle 150 relative to the bow limb 12 (including some of those described above). A bearing can be employed of any suitable type or arrangement. In embodiments lacking threaded engagement of the pulley member 100 with the axle 150 and lacking retention of the pulley member 100 by tightening of a threaded retaining member 159 against the pulley member 100, the axle 150 can rotate relative to the bow limb 12, the pulley member 100 can rotate relative to the axle 150, or both. One or more bearings of any suitable type or arrangement can be employed.

The example embodiments described above can be employed for one or both pulley assemblies of a compound archery bow of any type (e.g., dual-cam, single-cam, or hybrid-cam). For a dual-cam bow, typically both pulley assemblies are moveable among multiple transverse positions along their respective rotation axes. In single-cam or hybrid-cam bows, typically at least the pulley member that takes up the single power cable is moveable among multiple transverse positions along its rotation axis. If the power cable is taken up or let out by the other pulley member, typically that other pulley member is moveable among multiple transverse positions along its rotations axis as well.

A method for rigging any of the example embodiments of a compound bow 10 comprises: (A) fixing the pulley member 100 at a selected one of the multiple transverse positions along its rotations axis; (B) engaging the draw cable 30 with the draw cable grooves 102 so that the pulley members 100 rotate and let out the draw cable 30 as the bow 10 is drawn; and (C) coupling the power cable 30 to the bow 10 and engaging the power cable 30 with the power cable take-up mechanism 104 so that the power cable 30 is taken up as the corresponding pulley member 100 rotates as the bow 10 is drawn, which causes deformation of the bow limbs 12. To adjust the bow 10, one (or both) pulley members 100 can be moved from one transverse position along its rotation axis to a different transverse position.

Adjustment of the bow 10 by transverse movement of one or both pulley members 100 can be guided or optimized by any suitable or desired performance parameter or characteristic of the bow. Commonly, a transverse position of a pulley member 100 (or transverse positions of both pulley members 100 in some cases) is selected that results in improved or optimized aiming or alignment properties of the bow 10, e.g., based on the size of a grouping of arrows shot at a target, deviation of the arrow flight from a sighted target point, or so-called paper tuning (wherein an arrow is shot through a sheet of paper an close range: a single small hole indicates proper tuning, a vertical tear can be at least partly corrected by movement of the nock point on the bowstring, and a horizontal tear can be at least partly corrected by adjustment of one or more of the inventive arrangements disclosed herein).

The inventive embodiments described above enable the position or alignment of one or both power cables 35 at the end that is taken up when the bow is drawn. Instead, or in addition, the other, second end of the power cable can be arranged so as to enable alteration of the position or alignment of the power cable. The second end of a power cable 35 is coupled to the bow 10, usually to the other limb 12, to the other pulley member 100, or to an axle 150 on which the other pulley member is mounted; in some cases the second end of the power cable 35 is coupled to the riser 11 or to a stock of a crossbow. Wherever the second end of the power cable 35 is coupled to the bow 10, the inventive arrangements described below enable alteration of the position or alignment of the power cable 35. As noted above, the following description can apply to a single power cable 35 of a single-cam or hybrid-cam compound bow, or can apply to one or both power cables 35 of a dual-cam compound bow.

Figure 10:
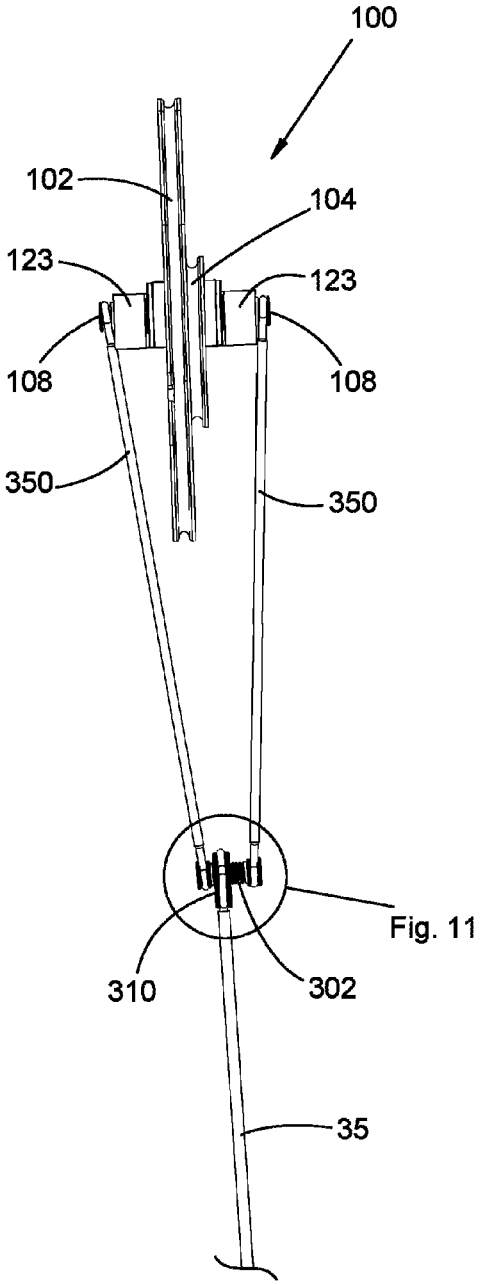
FIG. 10 illustrates schematically an example of a coupling member, a power cable anchor, and a pair of secondary power cables coupling a power cable to a bow.
Figure 11:
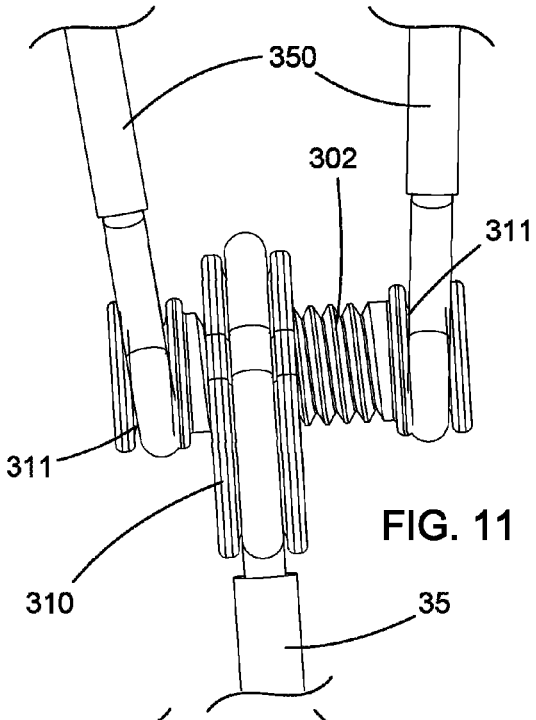
FIGS. 11 and 12 are enlarged views of the coupling member and power cable anchor of FIG. 10.
Figure 12:
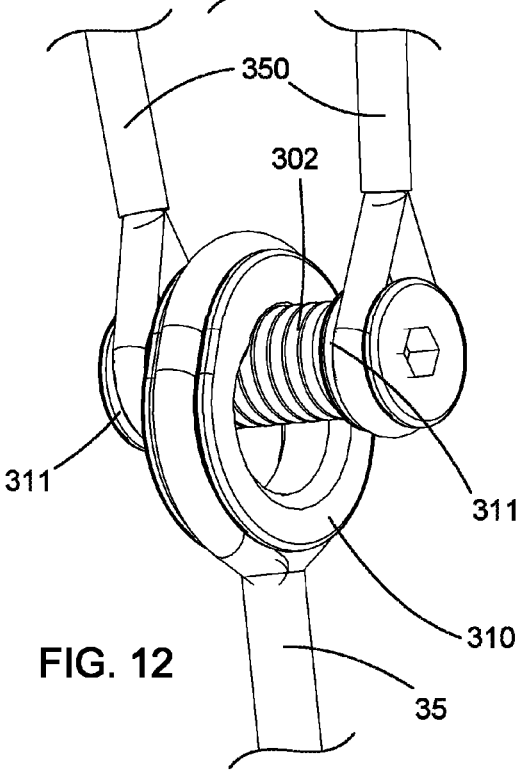
Figure 13:
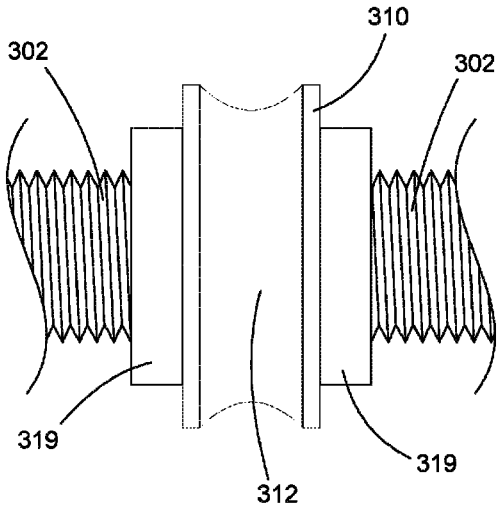
FIG. 13 illustrates schematically an example arrangement of retaining members engaging a threaded coupling member and a power cable anchor.
Figure 14:
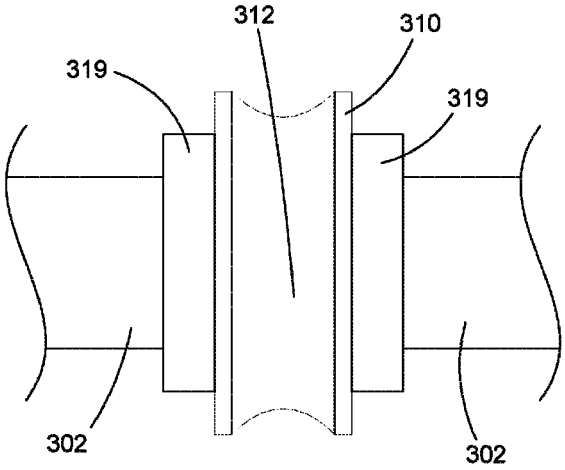
FIG. 14 illustrates schematically an example arrangement of retaining members engaging a non-threaded coupling member and a power cable anchor.
Figure 15:
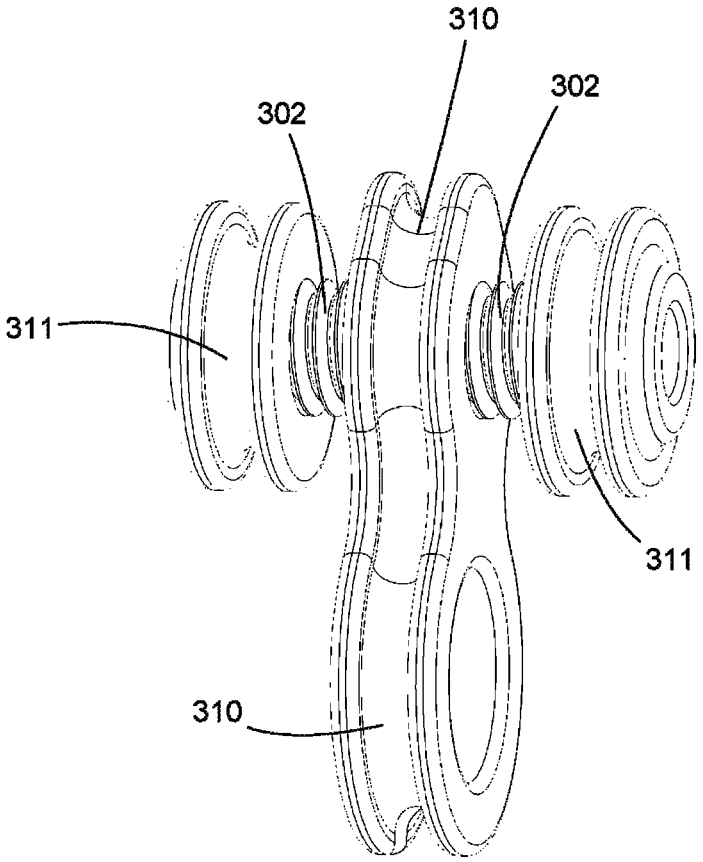
FIG. 15 illustrates schematically another example of a threaded coupling member and a power cable anchor.

Some inventive embodiments of a compound bow 10 (e.g., the example embodiment of FIG. 2) include a transverse coupling member 302 and a pair of secondary power cables 350 (e.g., as in FIGS. 10 through 12). The transverse coupling member 302 is connected to the bow 10 by the pair of transversely spaced-apart secondary power cables 350. The power cable 35 is arranged to be taken up by a first pulley member 100 on a first bow limb 12 as the bow 10 is drawn. The other end of the power cable 35 is connected to the transverse coupling member 302 in any one of multiple cable positions along the transverse coupling member 302 between the secondary power cables 350. The coupling member 302 and the secondary power cables 350 are arranged so as to couple the power cable 35 to the bow 10. Typically, the two secondary power cables 350 are connected to the bow 10 at the second bow limb 12, the second pulley member 100, or the transverse axle 150 on which the second pulley member 100 rotates. As noted above, in some examples the secondary power cables 350 are connected to the riser 11 or to the stock of a crossbow. By moving the attachment point of the power cable 35 among the multiple cable positions on the transverse coupling member 302, the position or alignment of the power cable 35 can be altered. As described above (for movement of the pulley member 100 along its rotation axis), adjustment of the position of the power cable 35 on the coupling member 302 can be guided or optimized by any suitable or desired performance parameter or characteristic of the bow, such as improved or optimized aiming or alignment properties of the bow 10.

In some embodiments (e.g., as in FIGS. 10 through 13 and 15), at least a central portion of the transverse coupling member 302 includes external threads. A power cable anchor 310 is engaged with the coupling member 302, and the power cable 35 is connected to the power cable anchor 310. In some examples the power cable anchor 310 includes a central bore and the transverse coupling member 302 passes through the bore; in some examples the power cable anchor can be arranged as in any of FIGS. 7A through 7F; in some examples the cable anchor 310 only partly encircles the coupling member 302, or engages only a portion of the circumference of the coupling member 302. The engagement of the power cable anchor 310 with the coupling member 302 and can be achieved in a variety of ways.

In some examples (e.g., as in FIGS. 10 through 13 and 15), the power cable anchor 310 is internally threaded and engages the threads of the transverse coupling member 302. In some examples, e.g., the example of FIGS. 11 and 12, the power cable anchor 310 threadedly engages only a portion of the circumference of the threaded coupling member 302; in other examples, e.g., the example of FIGS. 13 and 15, the threaded engagement can entirely encircle the coupling member 302. In threadedly engaged arrangements, movement of the power cable anchor 310 along the transverse coupling member 302 is effected by relative rotation of the threadedly engaged transverse coupling member 302 and power cable anchor 310, thereby altering the cable position where the power cable 35 is connected to the transverse coupling member 302. A substantially continuous range of cable positions along the transverse coupling member 302 can be provided in arrangements that include a threaded coupling member 302 and a threaded power cable anchor 310. One or both ends of the coupling member 302 has a socket, hex, slot, Phillips, or other suitable screw drive, or a knob or wingnut-like arrangement, to enable adjustment of the transverse position of the power cable anchor 310 relative to the coupling member 302. Because drawing and shooting the bow 10 does not require relative rotation of the coupling member 302 and the cable anchor 310, their threaded engagement and tension in the power cable 35 often can be sufficient to retain the cable anchor 310 at the selected cable position. In examples wherein the threaded power cable anchor 310 is arranged as in FIG. 7A, a set screw can be employed to retain the power cable anchor 310 at the selected power cable position along the coupling member 302; in examples wherein the threaded power cable anchor 310 is arranged as in FIG. 7B or 7C, the power cable anchor 310 can be clamped onto the retaining member 302 at the selected power cable position. In examples wherein the threaded power cable anchor 310 is arranged as in FIGS. 7D through 7F, a resilient member in the threaded central bore of the power cable anchor 310 against the threads of the coupling member 302 can effect frictional engagement, as described above.

In some examples (e.g., as in FIG. 13), one or more internally threaded retaining members 319 are threadedly engaged on the threaded transverse coupling member 302, and engagement of the power cable anchor 310 with the transverse coupling member 302 is effected by tightening the one or more threaded retaining members 319 against the power cable anchor 310 (only one threaded retaining member 319 acting as a jam nut sufficient if the cable anchor 310 is threaded; two threaded retaining members 319 needed on opposite sides of the cable anchor 310 if it is not threaded). If the power cable anchor 310 is not threaded, movement of the power cable anchor 310 among the multiple cable positions along the transverse coupling member 302 is effected by relative rotation of the transverse coupling member 302 and the threaded retaining members 319 threadedly engaged on the transverse coupling member 302, thereby altering the cable position where the power cable 35 is connected to the transverse coupling member 302. A substantially continuous range of cable positions along the transverse coupling member 302 can be provided in arrangements that include threads 303 on the coupling member 302. Threaded retaining member 319 can be arranged as shown on any of FIGS. 7A through 7F.

Instead of external threads, the transverse coupling member 302 can include a set of multiple circumferential grooves or ridges arranged along at least its central portion. Each one of the multiple grooves or ridges defines a corresponding one of a set of multiple discrete cable positions along the transverse coupling member 302; the power cable 35 can be moved by engaging the power cable anchor 310 with a different one of the grooves or ridges. In some examples engagement of the power cable anchor 310 with one of the slots or ridges, and tension on the power cable 35, can retain the power cable anchor 310 at the corresponding cable position along the coupling member 302; in some examples the power cable anchor can be arranged as in any one of FIGS. 7A through 7C for retention at a selected power cable position along the coupling member 302.

In embodiments including threads, grooves, or ridges, instead of employing a cable anchor 310, the power cable 35 can be connected to the transverse coupling member 302 directly, by being looped around the coupling member 302 in one of the threads, in one of the grooves, or between any pair of adjacent ridges. If threads are employed, movement of the power cable 35 to a different power cable position can be effected by rotation of the transverse coupling member 302. Wear caused by that rotation typically is not a concern, because adjustments would be expected to be small and infrequent. If grooves or ridges are employed, the looped power cable 35 is simply moved to a different groove or between a different pair of ridges.

In some examples the transverse coupling member 302 has neither threads nor grooves. The power cable anchor 310 is positioned on a central portion of the transverse coupling member 302 at any one of the multiple cable positions. In some examples the power cable anchor 310 can be held in place by a set screw, or by being arranged as a one or two-piece clamp (e.g., as in any one of FIGS. 7A through 7C). In some examples, the power cable anchor can be held in place on the coupling member 302 between a pair of retaining members 319 (e.g., as in any one of FIGS. 7A through 7C) on the transverse coupling member 302. Any of those arrangements provide a substantially continuous range of cable positions along the coupling member 302.

In some examples, the power cable 35 is connected to the power cable anchor 310 by being looped around the power cable anchor 310 in a peripheral groove 312 thereof (e.g., as in FIGS. 10 through 12). Other suitable arrangements can be employed for connecting the power cable 35 to the power cable anchor 310 (e.g., a ferrule). In some examples, the pair of secondary power cables 350 is connected to the transverse coupling member 302 by being looped around the coupling member 302 in corresponding lateral grooves 311 thereof (e.g., as in FIGS. 10 through 12). In some examples, a secondary cable anchor can be employed for each of the secondary power cables 350; such cable anchors can be arranged in a manner similar to any of the arrangements of the cable anchor 310 described above on threaded or non-threaded lateral portions of the coupling member 302. Other suitable arrangements can be employed for connecting the secondary power cables 350 to the transverse coupling member 302 (e.g., a ferrule).

In some examples the secondary power cables 350 can be connected to the second bow limb 12 using posts, anchors, ferrules, or other connections of any suitable type or arrangement. In some examples the secondary power cables can be connected to the second axle 150 (between the end portions 123 of the bow limb 12, or with the end portions 123 between the secondary power cables 350). In some examples the secondary power cables 350 can be looped around the axle 150, which can be provided with corresponding anchors, grooves, or ridges for receiving the secondary power cables 350. Cable anchors similar in type and arrangement to any of those described above can be employed if needed or desired.

In some examples (including dual-cam bows that employ a Binary Cam System®), the secondary power cables 350 are connected to the second pulley member 100, which is arranged so as to let out the secondary power cables 350 over a latter portion of drawing the bow 10. In addition, in some examples the second pulley member 100 can be arranged so as also to take up the secondary power cables 350 over an initial portion of drawing the bow 10 (e.g., as disclosed in U.S. Pat. No. 8,181,638 incorporated above). In some of those examples, the second pulley member 100 can include paired let-out members disposed on opposite sides of the second bow limb 12; each one of the pair of secondary power cables 350 is connected to a corresponding one of the paired let-out members. In some instances the paired let-out members comprise a pair of power cable anchors 108 that are eccentrically positioned relative to the second rotation axis defines by the second axle 150 (e.g., as in FIGS. 2 and 10).

In some examples the lengths of the secondary power cables 350 are the same as one another, while in other examples those lengths differ from each other. In some examples, the pair of secondary power cables 350 is arranged so as to enable adjustment of relative lengths of the secondary power cables 350 of the pair. A method for such a bow comprises altering the relative lengths of the secondary power cables 350 of the pair. That adjustment can be guided or optimized by any suitable or desired performance parameter or characteristic of the bow, such as improved or optimized aiming or alignment properties of the bow 10 (e.g., based on the size of a grouping of arrows shot at a target, or deviation of the arrow flight from a sighted target point, or paper tuning).

In some examples the effective attachment point of the power cable 35 is displaced from a transverse axis defined by the coupling member 302. In the example shown in FIG. 15, the cable anchor 310 is elongated so that portions of its circumferential groove extend away from the transverse coupling member 302. The threaded central bore of the cable anchor 310 engages the entire circumference of the threaded transverse coupling member 302, thereby limiting or preventing lateral angular motion (i.e., tilting) of the cable anchor 310 relative to the transverse coupling member 302. That rigid displacement of the anchor point for the power cable 350 from the axis of the transverse coupling member can reduce twisting of the bow limb 12 caused by the power cable 35 being deflected laterally relative to the shooting plane. If the power cable 35 and the secondary power cables 350 formed a conventional split-cable arrangement (i.e., without the coupling member 302 and cable anchor 310), then any lateral deflection of the power cable 35 from the shooting plane would torque the bow limb 12, causing it to twist. With the rigidly displaced power cable attachment provided by the cable anchor of FIG. 15, any lateral deflection of the power cable 35 would also tend to tilt the anchor 310 and the coupling member 302. However, the tension on the power cable 35 would tend to oppose that tilting, resulting in less torque transmitted to the bow limb and less twisting. A displacement of the power cable attachment point from the transverse coupling member 302 between about 0.5 inches and about 2 inches, typically about 1 inch, can be advantageously employed to reduce twisting of the bow limbs as the bow is drawn and the power cable 35 is further tensioned.

A method for rigging any of the example embodiments of a compound bow 10 comprises: (A) engaging the draw cable 30 with the draw cable grooves 102 so that the pulley members 100 rotate and let out the draw cable 30 as the bow 10 is drawn; (B) connecting the transverse coupling member 302 to the bow 10 with the pair of secondary power cables 350, and connecting the power cable 35 to the transverse coupling member 302 at a selected one of the multiple cable positions along its length; and (C) engaging the power cable 35 with the power cable take-up mechanism 104 so that the power cable 35 is taken up as the corresponding pulley member 100 rotates as the bow 10 is drawn, which causes deformation of one or both bow limbs 12. To adjust the bow 10, one (or both) power cables 35 can be moved from one cable position along the corresponding transverse coupling member 302 to a different, second cable position.

Adjustment of the bow 10—by transverse movement of the power cable 35 along the transverse coupling member 302, adjustment of the relative lengths of the secondary power cables 350, or both of those (for a single power cable 35, or for one or the other or both power cables 35, if two are present)—can be guided or optimized by any suitable or desired performance parameter or characteristic of the bow. Commonly, a transverse position of a pulley member 10 is selected that results in improved or optimized aiming or alignment properties of the bow 10 (e.g., based on the size of a grouping of arrows shot at a target, or deviation of the arrow flight from a sighted target point, or paper tuning).

One or the other or both of the arrangements disclosed herein for positioning and aligning the power cable 35 (i.e., (i) one or both pulley members 100 movable along their respective rotation axes, or (ii) one or both power cables 35 movable along a coupling member 302 connected to the bow by a pair of secondary power cables 350, with optional adjustment of relative lengths of the secondary power cables 350) can be employed for the power cable 35 of single-cam or hybrid-cam compound bow, or for one or both power cables 35 of a dual-cam compound bow. A user of a compound archery bow is thus provided with multiple adjustable parameters to tune the bow to suit a wide range of individual variations, preferences, or idiosyncrasies in shooting technique.

In addition to the preceding, the following examples fall within the scope of the present disclosure or appended claims:

Example 1

A compound archery bow comprising: (a) a substantially rigid riser; (b) a first resilient bow limb extending from a first end portion of the riser; (c) a second resilient bow limb extending from a second end portion of the riser; (d) a first transverse axle and a first pulley member, wherein the first transverse axle is mounted on the first bow limb so as to define a first transverse axis, the first pulley member is connected to the first transverse axle between spaced-apart end portions of the first bow limb, the first pulley member is rotatable relative to the first bow limb around the first rotation axis, and the first pulley member includes a first draw cable groove and a power cable take-up mechanism; (e) a second transverse axle and a second pulley member, wherein the second transverse axle is mounted on the second bow limb so as to define a second transverse axis, the second pulley member is connected to the second transverse axle between spaced-apart end portions of the second bow limb, the second pulley member is rotatable relative to the second bow limb around the second rotation axis, and the second pulley member includes a second draw cable groove; (f) a draw cable engaged with the first and second draw cable grooves and arranged to rotate the first and second pulley members as the bow is drawn and the draw cable is let out from the first and second draw cable grooves; and (g) a power cable (i) engaged to be taken up by the power cable take-up mechanism of the first pulley member as the bow is drawn and the first pulley member rotates and (ii) coupled to the bow so as to cause deformation of one or both bow limbs as the power cable is taken up, (h) wherein the first pulley member is fixed at any one of multiple transverse positions along the first rotation axis relative to the first bow limb by one or both of: (i) the first transverse axle being retained on the first bow limb at any one of multiple axle positions along the first rotation axis by engagement of the first transverse axle with the first bow limb, or (ii) the first pulley member being retained on the first transverse axle at any one of multiple pulley positions along the first transverse axle by engagement of the first pulley member with the first transverse axle.

Example 2

The bow of Example 1 wherein the second pulley member is fixed at any one of multiple transverse positions along the second rotation axis relative to the second bow limb by one or both of: (i) the second transverse axle being retained on the second bow limb at any one of multiple axle positions along the second rotation axis by engagement of the second transverse axle with the second bow limb, or (ii) the second pulley member being retained on the second transverse axle at any one of multiple pulley positions along the second transverse axle by engagement of the second pulley member with the second transverse axle.

Example 3

The bow of any one of Examples 1 or 2 wherein the power cable is coupled to the bow at the second bow limb, the second transverse axle, or the second pulley member.

Example 4

The bow of any one of Examples 1 through 3 wherein the first bow limb comprises a single limb, and the spaced-apart portions of the first bow limb are a pair of forked end portions of the single first bow limb.

Example 5

The bow of any one of Examples 1 through 3 wherein the first bow limb comprises a split limb, and the spaced-apart portions of the first bow limb are split-limb portions of the split-limb first bow limb.

Example 6

The bow of any one of Examples 1 through 5 wherein the first transverse axle is retained in a pair of coaxial bores through the spaced-apart portions of the first bow limb at any one of the multiple axle positions along the first rotation axis by engagement of the first transverse axle with the first bow limb.

Example 7

The bow of Example 6 wherein (i) one or both lateral portions of the first transverse axle are externally threaded, (ii) one or both of the pair of coaxial bores are internally threaded, (iii) engagement of the first transverse axle with the first bow limb is effected by threaded engagement of each threaded lateral portion of the first transverse axle in a corresponding one of the threaded bores of the first bow limb, and (iv) movement of the first transverse axle along the first rotation axis is effected by rotation of the first transverse axle threadedly engaged in one or both of the bores.

Example 8

The bow of Example 7 wherein one or more internally threaded retaining members are threadedly engaged on the first transverse axle and are arranged so that tightening the one or more retaining members against the first bow limb retains the first transverse axle at one of the multiple axle positions.

Example 9

The bow of any one of Examples 7 or 8 wherein two or more retaining flanges are positioned on the first transverse axle and are arranged so that securing the two or more retaining flanges to the first transverse axle with the two or more retaining flanges positioned against the first bow limb retains the first transverse axle at one of the multiple axle positions.

Example 10

The bow of any one of Examples 7 through 9 wherein one or more set screws are threadedly engaged in one or more corresponding threaded holes in the first bow limb and are arranged so that tightening the one or more set screws against the first transverse axle in at least one of the bores retains the first transverse axle at one of the multiple axle positions.

Example 11

The bow of any one of Examples 7 through 10 wherein at least one of the pair of bores of the first bow limb is arranged as a clamp, and each clamp is arranged so that tightening the clamp retains the first transverse axle at one of the multiple axle positions.

Example 12

The bow of any one of Examples 7 through 11 wherein a resilient member is disposed within at least one of the bores against threads of the transverse axle and arranged so as to effect frictional engagement of the transverse axle with at least one of the bores.

Example 13

The bow of any one of Examples 6 through 12 wherein at least one or both lateral portions of the first transverse axle are externally threaded, and two or more internally threaded retaining members are threadedly engaged on the first transverse axle and are arranged so that tightening the one or more retaining members against the first bow limb effects engagement of the first transverse axle with the first bow limb and retains the first transverse axle at one of the multiple axle positions.

Example 14

The bow of any one of Examples 6 through 13 wherein two or more retaining flanges are positioned on the first transverse axle and are arranged so that securing the two or more retaining flanges to the first transverse axle with the two or more retaining flanges positioned against the first bow limb effects engagement of the first transverse axle with the first bow limb and retains the first transverse axle at one of the multiple axle positions.

Example 15

The bow of any one of Examples 6 through 14 wherein one or more set screws are threadedly engaged in one or more corresponding threaded holes in the first bow limb and are arranged so that tightening the one or more set screws against the first transverse axle in one or both of the pair of bores effects engagement of the first transverse axle with the first bow limb and retains the first transverse axle at one of the multiple axle positions.

Example 16

The bow of any one of Examples 6 through 15 wherein the pair of bores of the first bow limb are each arranged as a clamp, and each clamp is arranged so that tightening the clamp effects engagement of the first transverse axle with the first bow limb and retains the first transverse axle at one of the multiple axle positions.

Example 17

The bow of any one of Examples 1 through 16 wherein the first pulley member is retained on the first transverse axle at any one of the multiple pulley positions along the first transverse axle by engagement of the first pulley member with the first transverse axle.

Example 18

The bow of Example 17 wherein (i) at least a central portion of the first transverse axle is externally threaded, (ii) a central bore of the first pulley member is internally threaded, (iii) retention of the first pulley member at any one of the multiple positions along the first transverse axle is effected by threaded engagement of the externally threaded portion of the transverse axle in the internally threaded central bore of the pulley member and by an internally threaded retaining member threadedly engaged on the central portion of the first transverse axle and tightened against a side of the first pulley member, and (iv) the transverse axle and the pulley member are arranged so that movement of the first pulley member along the first transverse axle is effected by rotation of the transverse axle relative to the threadedly engaged pulley member.

Example 19

The bow of any one of Examples 16 or 17 wherein (i) at least a central portion of the first transverse axle is externally threaded, (ii) engagement of the first pulley member with the first transverse axle is effected by retention of the first pulley member at any one of the multiple positions along the first transverse axle between a pair of internally threaded retaining members threadedly engaged on the central portion of the first transverse axle and tightened against opposite sides of the first pulley member, and (iii) the transverse axle and the pair of retaining members are arranged so that movement of the first pulley member along the first transverse axle is effected by rotation of the pair of retaining members threadedly engaged on the central portion of the first transverse axle and positioned against the opposite sides of the first pulley member.

Example 20

The bow of any one of Examples 16 through 18 wherein engagement of the first pulley member with the first transverse axle is effected by retention of the first pulley member at any one of the multiple positions along the first transverse axle between a pair of retaining flanges secured in any pair of multiple flange positions on a central portion of the first transverse axle and positioned against opposite sides of the first pulley member.

Example 21

The bow of any one of Examples 1 through 20, further comprising a transverse coupling member and a pair of spaced-apart secondary power cables, wherein (i) the transverse coupling member is connected to the bow by the pair of transversely spaced-apart flexible secondary power cables, (ii) the power cable is connected to the transverse coupling member at any one of multiple cable positions along the transverse coupling member between the pair of secondary power cables, and (iii) the coupling member and the pair of secondary power cables are arranged so as to couple the power cable to the bow.

Example 22

A compound archery bow comprising: (a) a substantially rigid riser; (b) a first resilient bow limb extending from a first end portion of the riser; (c) a second resilient bow limb extending from a second end portion of the riser; (d) a first pulley member mounted on and rotatable relative to the first bow limb around a first transverse rotation axis, wherein the first pulley member includes a first draw cable groove and a power cable take-up mechanism; (e) a second pulley member mounted on and rotatable relative to the second bow limb around a second transverse rotation axis, wherein the second pulley member includes a second draw cable groove; (f) a draw cable engaged with the first and second draw cable grooves and arranged to rotate the first and second pulley members as the bow is drawn and the draw cable is let out from the first and second draw cable grooves; (g) a power cable (i) engaged to be taken up by the power cable take-up mechanism of the first pulley member as the bow is drawn and the first pulley member rotates and (ii) coupled to the bow so as to cause deformation of one or both bow limbs as the power cable is taken up; and (h) a transverse coupling member and a pair of spaced-apart secondary power cables, wherein (i) the transverse coupling member is connected to the bow by the pair of transversely spaced-apart flexible secondary power cables, (ii) the power cable is connected to the transverse coupling member at any one of multiple cable positions along the transverse coupling member between the pair of secondary power cables, and (iii) the coupling member and the pair of secondary power cables are arranged so as to couple the power cable to the bow.

Example 23

The bow of any one of Examples 21 or 22 further comprising: (g) a second power cable (i) engaged to be taken up by a second power cable take-up mechanism of the second pulley member as the bow is drawn and the second pulley member rotates and (ii) coupled to the bow so as to cause deformation of one or both bow limbs as the power cable is taken up; and (h) a second transverse coupling member and a second pair of spaced-apart secondary power cables, wherein (i) the second transverse coupling member is connected to the bow by the second pair of transversely spaced-apart flexible secondary power cables, (ii) the second power cable is connected to the second transverse coupling member at any one of multiple cable positions along the second transverse coupling member between the second pair of secondary power cables, and (iii) the second coupling member and the second pair of secondary power cables are arranged so as to couple the second power cable to the bow.

Example 24

The bow of any one of Examples 21 through 23 wherein (i) a power cable anchor is engaged with a central portion of the transverse coupling member so as to substantially prevent lateral tilting of the power cable anchor relative to the transverse coupling member, (ii) the power cable is connected to the power cable anchor at a point that is displaced from an axis defined by the transverse coupling member, and (iii) the power cable is connected to the transverse coupling member by engagement of the power cable anchor with the central portion of the transverse coupling member.

Example 25

The bow of any one of Examples 21 through 24 wherein the power cable is coupled to the bow at the second bow limb, the second transverse axle, or the second pulley member.

Example 26

The bow of any one of Examples 21 through 25 wherein (i) at least a central portion of the transverse coupling member is externally threaded, (ii) a power cable anchor is engaged with the central portion of the transverse coupling member, (iii) the power cable is connected to the power cable anchor, and (iv) the power cable is connected to the transverse coupling member by engagement of the power cable anchor with the central portion of the transverse coupling member.

Example 27

The bow of Example 26 wherein (i) the power cable anchor is internally threaded and is threadedly engaged on the central portion of the transverse coupling member, and (ii) movement of the power cable anchor along the transverse coupling member is effected by relative rotation of the transverse coupling member and the power cable anchor, thereby altering the cable position where the power cable is connected to the transverse coupling member.

Example 28

The bow of any one of Examples 26 or 27 wherein (i) one or more internally threaded retaining members are threadedly engaged on the central portion of the transverse coupling member, (ii) engagement of the power cable anchor with the transverse coupling member is effected by tightening the one or more retaining members against the power cable anchor, and (iii) movement of the power cable anchor among the multiple cable positions along the transverse coupling member is effected by relative rotation of the transverse coupling member and one or more of the retaining members threadedly engaged on the transverse coupling member, thereby altering the cable position where the power cable is connected to the transverse coupling member.

Example 29

The bow of any one of Examples 26 through 28 wherein the power cable is looped around the power cable anchor in a peripheral groove thereof.

Example 30

The bow of any one of Examples 21 through 25 wherein (i) at least a central portion of the transverse coupling member has a set of multiple circumferential grooves arranged along the transverse coupling member, and (ii) each one of the multiple grooves defines a corresponding one of the multiple cable positions.

Example 31

The bow of Example 30 wherein the power cable is looped around the transverse coupling member in one of the multiple grooves.

Example 32

The bow of Example 30 wherein (i) a power cable anchor is positioned on the central portion of the transverse coupling member and is engaged with one of the multiple circumferential grooves, and (ii) the power cable is connected to the power cable anchor.

Example 33

The bow of Example 32 wherein the power cable is looped around the power cable anchor in a peripheral groove thereof.

Example 34

The bow of any one of Examples 21 through 25 wherein (i) a power cable anchor is positioned on a central portion of the transverse coupling member, (ii) the power cable is connected to the power cable anchor, and (iii) the power cable anchor is held at any one of the multiple cable positions by a set screw, by being arranged as a one or two-piece clamp, or by one or more retainers on the transverse coupling member.

Example 35

The bow of Example 34 wherein the power cable is looped around the power cable anchor in a peripheral groove thereof.

Example 36

The bow of any one of Examples 21 through 25 wherein (i) at least a central portion of the transverse coupling member includes a set of external threads, (ii) the power cable is looped around the transverse coupling member in one of the external threads, and (iii) the bow is arranged so that movement of the looped power cable along the transverse coupling member is effected by relative rotation of the transverse coupling member and the looped power cable.

Example 37

The bow of any one of Examples 21 through 36 wherein the secondary power cables are connected to the second bow limb.

Example 38

The bow of any one of Examples 21 through 36 wherein the secondary power cables are connected to the second transverse axle.

Example 39

The bow of any one of Examples 21 through 36 wherein the secondary power cables are connected to the second pulley member, and the second pulley member is arranged so as to let out the secondary power cables over a latter portion of drawing the bow.

Example 40

The bow of Example 39 wherein the second pulley member is arranged so as to take up the secondary power cables over an initial portion of drawing the bow.

Example 41

The bow of any one of Examples 39 or 40 wherein the second pulley member includes paired let-out members disposed on opposite sides of the second bow limb, and each one of the pair of secondary power cables is connected to a corresponding one of the paired let-out members.

Example 42

The bow of Example 41 wherein the paired let-out members comprise a pair of power cable anchors that are eccentrically positioned relative to the second rotation axis.

Example 43

The bow of any one of Examples 21 through 42 wherein lengths of the secondary power cables of the pair differ from each other.

Example 44

The bow of any one of Examples 21 through 43 wherein the pair of secondary power cables is arranged so as to enable adjustment of relative lengths of the secondary power cables of the pair.

Example 45

A method for adjusting the bow of Example 44, the method comprising altering the relative lengths of the secondary power cables of the pair.

Example 46

A method for rigging the bow of any one of Examples 21 through 44, the method comprising: (A) engaging the draw cable with the first and second draw cable grooves so that the first and second pulley members rotate and let out the draw cable as the bow is drawn; (B) connecting the transverse coupling member to the bow with the pair of secondary power cables, and connecting the power cable to the transverse coupling member at a selected one of the multiple cable positions along the transverse coupling member; and (C) engaging the power cable with the power cable take-up mechanism so that the power cable is taken up as the first pulley member rotates as the bow is drawn, thereby causing deformation of one or both bow limbs.

Example 47

A method for adjusting the bow of any one of Examples 21 through 44, the method comprising moving the power cable from a first one of the multiple cable positions along the transverse coupling member to a different, second one of the multiple cable positions along the transverse coupling member.

Example 48

A method for rigging the bow of any one of Examples 1 through 20 or 22 through 44, the method comprising: (A) fixing the first pulley member at a selected one of the multiple transverse positions along the first rotations axis; (B) engaging the draw cable with the first and second draw cable grooves so that the first and second pulley members rotate and let out the draw cable as the bow is drawn; and (C) coupling the power cable to the bow and engaging the power cable with the power cable take-up mechanism so that the power cable is taken up as the first pulley member rotates as the bow is drawn, thereby causing deformation of one or both bow limbs.

Example 49

A method for adjusting the bow of any one of Examples 1 through 20 or 22 through 44, the method comprising moving the first pulley member from a first one of the multiple transverse positions along the first rotations axis to a different, second one of the multiple transverse positions along the first rotations axis.

The embodiments (processes, machines, articles, or compositions) described or shown herein are only examples presented to demonstrate inventive subject matter; any appearance of the term "embodiment" should be regarded as implicitly including the modifying term "example" if that modifier is not explicitly included. It is intended that equivalents of the disclosed embodiments shall fall within the scope of the present disclosure or appended claims. It is intended that the disclosed embodiments, and equivalents thereof, may be modified while remaining within the scope of the present disclosure or appended claims.

In the foregoing Detailed Description, various features may be grouped together in several disclosed example embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of any single disclosed example embodiment. Thus, the appended claims are hereby incorporated into the Detailed Description, with each claim standing on its own as a separate disclosed example embodiment. However, the present disclosure shall also be construed as implicitly disclosing any embodiment having any suitable set of one or more disclosed or claimed features (i.e., a set of features that are neither incompatible nor mutually exclusive) that appear in the present disclosure or the appended claims, including those sets that may not be explicitly disclosed herein. In addition, for purposes of disclosure, each of the appended dependent claims shall be construed as if written in multiple dependent form and dependent upon all preceding claims with which it is not inconsistent. It should be further noted that the scope of the appended claims does not necessarily encompass the whole of the inventive subject matter disclosed herein.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes of the present disclosure and appended claims, the words "comprising," "including," "having," and variants thereof, wherever they appear, shall be construed as open ended terminology, with the same meaning as if the phrase "at least" were appended after each instance thereof, unless explicitly stated otherwise. For purposes of the present disclosure or appended claims, when terms are employed such as "about equal to," "substantially equal to," "greater than about," "less than about," and so forth, in relation to a numerical quantity, standard conventions pertaining to measurement precision and significant digits shall apply, unless a differing interpretation is explicitly set forth. For null quantities described by phrases such as "substantially prevented," "substantially absent," "substantially eliminated," "about equal to zero," "negligible," and so forth, each such phrase shall denote the case wherein the quantity in question has been reduced or diminished to such an extent that, for practical purposes in the context of the intended operation or use of the disclosed or claimed apparatus or method, the overall behavior or performance of the apparatus or method does not differ from that which would have occurred had the null quantity in fact been completely removed, exactly equal to zero, or otherwise exactly nulled.

In the appended claims, any labelling of elements, steps, limitations, or other portions of a claim (e.g., first, second, etc., (a), (b), (c), etc., or (i), (ii), (iii), etc.) is only for purposes of clarity, and shall not be construed as implying any sort of ordering or precedence of the claim portions so labelled. If any such ordering or precedence is intended, it will be explicitly recited in the claim or, in some instances, it will be implicit or inherent based on the specific content of the claim. In the appended claims, if the provisions of 35 USC §112(f) are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC §112(f) are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. A compound archery bow comprising:

(a) a substantially rigid riser;

(b) a first resilient bow limb extending from a first end portion of the riser;

(c) a second resilient bow limb extending from a second end portion of the riser;

(d) a first transverse axle and a first pulley member, wherein the first transverse axle is mounted on the first bow limb so as to define a first transverse axis, the first pulley member is connected to the first transverse axle between spaced-apart end portions of the first bow limb, the first pulley member is rotatable relative to the first bow limb around the first rotation axis, and the first pulley member includes a first draw cable groove and a power cable take-up mechanism;

(e) a second transverse axle and a second pulley member, wherein the second transverse axle is mounted on the second bow limb so as to define a second transverse axis, the second pulley member is connected to the second transverse axle between spaced-apart end portions of the second bow limb, the second pulley member is rotatable relative to the second bow limb around the second rotation axis, and the second pulley member includes a second draw cable groove;

(f) a draw cable engaged with the first and second draw cable grooves and arranged to rotate the first and second pulley members as the bow is drawn and the draw cable is let out from the first and second draw cable grooves; and (g) a power cable (i) engaged to be taken up by the power cable take-up mechanism of the first pulley member as the bow is drawn and the first pulley member rotates and (ii) coupled to the bow so as to cause deformation of one or both bow limbs as the power cable is taken up, (h) wherein the first pulley member is fixed at any one of multiple transverse positions along the first rotation axis relative to the first bow limb by one or both of: (i) the first transverse axle being retained on the first bow limb at any one of multiple axle positions along the first rotation axis by engagement of the first transverse axle with the first bow limb, or (ii) the first pulley member being retained on the first transverse axle at any one of multiple pulley positions along the first transverse axle by engagement of the first pulley member with the first transverse axle.

2. The bow of claim 1 wherein the second pulley member is fixed at any one of multiple transverse positions along the second rotation axis relative to the second bow limb by one or both of: (i) the second transverse axle being retained on the second bow limb at any one of multiple axle positions along the second rotation axis by engagement of the second transverse axle with the second bow limb, or (ii) the second pulley member being retained on the second transverse axle at any one of multiple pulley positions along the second transverse axle by engagement of the second pulley member with the second transverse axle.

3. The bow of claim 1 wherein the power cable is coupled to the bow at the second bow limb, the second transverse axle, or the second pulley member.

4. The bow of claim 1 wherein the first transverse axle is retained in a pair of coaxial bores through the spaced-apart portions of the first bow limb at any one of the multiple axle positions along the first rotation axis by engagement of the first transverse axle with the first bow limb.

5. The bow of claim 4 wherein (i) one or both lateral portions of the first transverse axle are externally threaded, (ii) one or both of the pair of coaxial bores are internally threaded, (iii) engagement of the first transverse axle with the first bow limb is effected by threaded engagement of each threaded lateral portion of the first transverse axle in a corresponding one of the threaded bores of the first bow limb, and (iv) the transverse axle and the pair of coaxial bores are arranged so that movement of the first transverse axle along the first rotation axis is effected by rotation of the first transverse axle threadedly engaged in one or both of the bores.

6. The bow of claim 5 wherein one or more internally threaded retaining members are threadedly engaged on the first transverse axle and are arranged so that tightening the one or more retaining members against the first bow limb retains the first transverse axle at one of the multiple axle positions.

7. The bow of claim 5 wherein two or more retaining flanges are positioned on the first transverse axle and are arranged so that securing the two or more retaining flanges to the first transverse axle with the two or more retaining flanges positioned against the first bow limb retains the first transverse axle at one of the multiple axle positions.

8. The bow of claim 5 wherein one or more set screws are threadedly engaged in one or more corresponding threaded holes in the first bow limb and are arranged so that tightening the one or more set screws against the first transverse axle in at least one of the bores retains the first transverse axle at one of the multiple axle positions.

9. The bow of claim 5 wherein at least one of the pair of bores of the first bow limb is arranged as a clamp, and each clamp is arranged so that tightening the clamp retains the first transverse axle at one of the multiple axle positions.

10. The bow of claim 5 wherein a resilient member is disposed within at least one of the bores against threads of the transverse axle and arranged so as to effect frictional engagement of the transverse axle with at least one of the bores.

11. The bow of claim 4 wherein at least one or both lateral portions of the first transverse axle are externally threaded, and two or more internally threaded retaining members are threadedly engaged on the first transverse axle and are arranged so that tightening the one or more retaining members against the first bow limb effects engagement of the first transverse axle with the first bow limb and retains the first transverse axle at one of the multiple axle positions.

12. The bow of claim 4 wherein two or more retaining flanges are positioned on the first transverse axle and are arranged so that securing the two or more retaining flanges to the first transverse axle with the two or more retaining flanges positioned against the first bow limb effects engagement of the first transverse axle with the first bow limb and retains the first transverse axle at one of the multiple axle positions.

13. The bow of claim 4 wherein one or more set screws are threadedly engaged in one or more corresponding threaded holes in the first bow limb and are arranged so that tightening the one or more set screws against the first transverse axle in one or both of the pair of bores effects engagement of the first transverse axle with the first bow limb and retains the first transverse axle at one of the multiple axle positions.

14. The bow of claim 4 wherein the pair of bores of the first bow limb are each arranged as a clamp, and each clamp is arranged so that tightening the clamp effects engagement of the first transverse axle with the first bow limb and retains the first transverse axle at one of the multiple axle positions.

15. The bow of claim 1 wherein the first pulley member is retained on the first transverse axle at any one of the multiple pulley positions along the first transverse axle by engagement of the first pulley member with the first transverse axle.

16. The bow of claim 15 wherein (i) at least a central portion of the first transverse axle is externally threaded, (ii) a central bore of the first pulley member is internally threaded, (iii) retention of the first pulley member at any one of the multiple positions along the first transverse axle is effected by threaded engagement of the externally threaded portion of the transverse axle in the internally threaded central bore of the pulley member and by an internally threaded retaining member threadedly engaged on the central portion of the first transverse axle and tightened against a side of the first pulley member, and (iv) the transverse axle and the pulley member are arranged so that movement of the first pulley member along the first transverse axle is effected by rotation of the transverse axle relative to the threadedly engaged pulley member.

17. The bow of claim 15 wherein (i) at least a central portion of the first transverse axle is externally threaded, (ii) engagement of the first pulley member with the first transverse axle is effected by retention of the first pulley member at any one of the multiple positions along the first transverse axle between a pair of internally threaded retaining members threadedly engaged on the central portion of the first transverse axle and tightened against opposite sides of the first pulley member, and (iii) the transverse axle and the pair of retaining members are arranged so that movement of the first pulley member along the first transverse axle is effected by rotation of the pair of retaining members threadedly engaged on the central portion of the first transverse axle and positioned against the opposite sides of the first pulley member.

18. The bow of claim 15 wherein engagement of the first pulley member with the first transverse axle is effected by retention of the first pulley member at any one of the multiple positions along the first transverse axle between a pair of retaining flanges secured in any pair of multiple flange positions on a central portion of the first transverse axle and positioned against opposite sides of the first pulley member.

19. A method for rigging the bow of claim 1, the method comprising:

(A) fixing the first pulley member at a selected one of the multiple transverse positions along the first rotations axis;

(B) engaging the draw cable with the first and second draw cable grooves so that the first and second pulley members rotate and let out the draw cable as the bow is drawn; and (C) coupling the power cable to the bow and engaging the power cable with the power cable take-up mechanism so that the power cable is taken up as the first pulley member rotates as the bow is drawn, thereby causing deformation of one or both bow limbs.

20. A method for adjusting the bow of claim 1, the method comprising moving the first pulley member from a first one of the multiple transverse positions along the first rotations axis to a different, second one of the multiple transverse positions along the first rotations axis.

* * * * *